US005938374A

United States Patent [19]

Nakase et al.

[11] Patent Number: 5,938,374

[45] Date of Patent: Aug. 17, 1999

[54] SOFT LANDING STRUCTURE AND METHOD SETTING THE SAME

[75] Inventors: Akio Nakase; Yoshio Ozawa; Noriaki Masaki; Kunio Isemura; Masaaki Terashi, all of Tokyo, Japan

[73] Assignee: Nikkensekkei Ltd., Osaka, Japan

[21] Appl. No.: 08/913,064

[22] PCT Filed: Feb. 17, 1995

[86] PCT No.: PCT/JP95/00221

§ 371 Date: Jan. 20, 1998

§ 102(e) Date: Jan. 20, 1998

[87] PCT Pub. No.: WO96/25561

PCT Pub. Date: Aug. 22, 1996

[51] Int. Cl.[6] ..... E02B 17/02

[52] U.S. Cl. ..... 405/205; 405/195.1; 405/203

[58] Field of Search ..... 405/204–209, 405/195.1–199, 8–14

[56] References Cited

U.S. PATENT DOCUMENTS

| | | | |
|---|---|---|---|
| 2,900,794 | 8/1959 | Sutton | 405/204 |
| 3,589,133 | 6/1971 | Lowd et al. | 405/204 |
| 4,007,598 | 2/1977 | Tax | 405/204 X |
| 4,478,537 | 10/1984 | Birdy . | |
| 4,746,245 | 5/1988 | Mork | 405/204 X |
| 4,799,828 | 1/1989 | Georgii . | |
| 4,810,135 | 3/1989 | Davenport et al. | 405/204 X |

FOREIGN PATENT DOCUMENTS

| | | | |
|---|---|---|---|
| 0199690 | 10/1986 | European Pat. Off. . | |
| 615390 | 2/1986 | Japan . | |
| 6149016 | 3/1986 | Japan . | |
| 119484 | 4/1989 | Japan . | |
| 1219207 | 9/1989 | Japan . | |
| 220768 | 5/1990 | Japan . | |
| 485410 | 3/1992 | Japan . | |
| 2229476 | 9/1990 | United Kingdom | 405/204 |
| WO8602966 | 5/1986 | WIPO . | |

*Primary Examiner*—Dennis L. Taylor
*Attorney, Agent, or Firm*—Muramatsu & Associates

[57] ABSTRACT

A soft landing structure to be installed on the water bottom ground with decreased cost and construction time. The soft landing structure includes a ballast tank for storing a desired amount of water, a lower structure connected to a top of the ballast tank under the surface of the sea water, and an upper structure mounted on the lower structure at least a part of the upper structure is positioned above the surface of the sea water. The soft landing structure is placed on the water bottom ground which has been improved to increase strength of the ground against overall weight of the soft landing structure. The soft landing structure is installed on the water bottom ground under the condition that the amount of water in the ballast tank is regulated so that the soft landing structure remains on the water bottom ground without floating up and without causing subsidence of the ground even if a sea water level varies, and stays on the water bottom ground with appropriate contact pressure enough to withstand against horizontal forces caused by sea waves and the like.

22 Claims, 23 Drawing Sheets

SOFT LANDING STRUCTURE AND METHOD SETTING THE SAME

FIELD OF THE INVENTION

This invention relates to a soft landing structure installed on the bottom of the ocean or other water areas in the landing state without settling, nor floating up to the surface, and an installation method of such a soft landing structure. An accomplished soft landing structure has functions equivalent to those of a land structure, and can be utilized as infrastructures including the basis of production, seawater-to-fresh water distillation facilities, and refuse disposal plants, in addition to housing facilities and recreational facilities.

BACKGROUND OF THE INVENTION

A conventional method of constructing a structure on the sea is roughly classified into two. One is a creation of a land on the sea either by "reclamation" or by "reclamation by drainage" followed by an ordinary construction of a structure on the land. The other is a floatation of a structure on the sea. The reclamation method is that an embankment is constructed along the periphery of an expected reclaimed land, which sea-bottom poor subsoil at the area to be reclaimed is improved, and a strucuture is constructed on the ground prepared by filling up an embanked area with earth and sand or the like. The method of land reclamation by drainage is that a bank is constructed in the shallow water offshore, water is drained from an embanked area to expose the ground at sea-bottom, and a construction of a structure is executed similarly to the reclamation method. The flotation method is that a floating structure is allowed to simply keep afloat on the sea due to buoyancy, while being moored to the bottom of the sea.

Among the above methods, the construction of a structure by the reclamation method is accomplished through process of execution of works similar to the construction of a normal land structure, after the reclaimed land has been created and improved if necessary. Therefore, the structure in this case, when accomplished, is resistant to wind, tidal current or the like as the land structure. On the other hand, a lot of time and cost have been required to suffer a great loss in a term of works and a cost of construction, until a start is made with construction of a structure. Besides, there is a possibility of encountering the settlement of ground with the passage of time or a liquefaction risk when an earthquake happened. It should be noted that, within the context of the present specification, terms "settling" and "settlement" refer to subsidence or sinking of the land at the water bottom due to the weight of the structure. Further, within the context of the specification, terms "improve" or "improvement" of land refers to procedures on the land at the water bottom to increase the strength thereof against the weight of the structure. Further, when a place adjoining the already-reclaimed land is reclaimed, the already-reclaimed land is dragged toward a newly-reclaimed land. Thus, the existing facilities on the already-reclaimed land are liable to differential settlement. As a result, it is greatly difficult to enlarge the plan of reclamation according to the reclamation method.

According to the method of a land reclamation by drainage, since the reclaimed ground is on a level with or below the surface of the sea, the safety of a structure against disaster is dependent on the reliability of the bank. However, when the bank is broken due to an earthquake or storm surge, the structure is left in a defenseless state. Further, a long period of time should be spared for the construction of bank and drainage of water as preliminary works for the construction of the structure, similarly to the reclamation method.

The structure according to the flotation method is separated from the sea-bottom ground, and hence, is not directly affected by seismic force, nor settles. Thus, this structure is highly secured against earthquake damage. However, since the structure is afloat on the sea it is easily subjected to rocking motion due to wind or tidal current. Such a floating structure has a defect in stability, and in the worst case, is in danger of drifting, sinking or capsizing. Further, when the area of the structure is enlarged, the stiffness of the structure is relatively reduced. However, as long as the structure is afloat on the sea, the floating structure is always affected by the tidal current, and is liable to partially disordered motion. As a result, it is not possible to attain a structure of a substantially large plane area.

As described above, the conventional methods other than the flotation method inevitably require a long period of time until the completion of the structure, and pose various problems including points on preservation of environment. Namely, a construction field cannot be restored to the former condition, after the construction work has been accomplished.

In view of the background art described above, the present applicant has proposed a structure and an installation method thereof in Japanese Patent Laid-open No. 4-85410 in order to overcome the weak points of the conventional methods. According to this proposal, the contact pressure of a structure is set to the desired degree by regulating the own weight of the structure with water serving as ballast, and the structure thus ballasted is installed on the excavated bottom of the sea, whereby the structure lands on the bottom of the sea without floating up to the surface, nor settling, and maintains the stable state so as to be resistant to horizontal force caused by an earthquake, waves and tidal current or the like. Therefore, the structure and the installation method thereof thus proposed have the advantages of not only reducing a term of works and a cost of construction, but also attaining high safety and stability on the sea. However, the structure is installed without settling or maintains the stability to be resistant to horizontal force in dependence on only the effect of excavation of the ground. Thus, a considerable range of the bottom of the sea should be excavated in accordance with the ground conditions, or other conditions such as the range of variation in the water level and the magnitude of wave pressure, and in the worst case, the execution of works itself fails to realize.

Further, the horizontal stability of the structure in the floating state under tugging or construction and that of the accomplished structure in the landing state can be ensured by regulating the quantity of water in each ballast tank. However, when only a pair of ballast tanks are provided in one direction, it is difficult to ensure the stability of the structure in the direction orthogonal to the ballast tanks.

SUMMARY OF THE INVENTION

The present invention is derived from the invention described above, and an object of the present invention is to provide a structure which maintains the stable landing state according to a technique different from that of the invention described above, and an installation method of such a structure.

According to the present invention, the contact pressure of a structure is regulated with water serving as ballast, while the candidate water-bottom ground for installation is slightly improved and so on without excessive excavation, and the structure is installed on the bottom of the water without floating up to the surface, nor causing harmful settlement, similarly to the invention disclosed in Japanese Patent Laid-open No. 4-85410, whereby the structure is stabilized so as to be resistant to external force such as waves, tidal current and earthquakes, and is prevented from capsizing, sinking, drifting or like troubles accompanying the installation of the structure in the water area to result in the solution of all the problems in the conventional methods.

The structure can be installed on the bottom of the water in the submerged state without settlement on condition that stress in a ground at a certain depth determined by the sum of self-weight stress caused by the self-weight of the soil above that depth and the additional stress induced at the depth by the contact pressure of the structure is set not to exceed the consolidation yield stress of the ground at the depth. The stress in a groung can be set to the desired level by means of arbitrarily regulating buoyancy acting on the structure provided with a plurality of ballast tanks capable of being charged with water, together with the excavation of the ground at need. The consolidation yield stress can be held higher than the stress in a ground by means of slightly improving the ground or excavating the ground together with the ground improvement.

The stress in a ground at a certain depth which is not affected by the external force caused by the structure or the like is determined by the self-weight of the soil above that depth up to the ground surface. When the additional stress (contact pressure) is applied to the ground surface by constructing a structure, the stress in a ground just beneath the structure, is increased by the amount corresponding to the applied contact pressure. On the other hand, the additional stress applied to the ground surface is propagated through the ground, and is allowed to act wider area than the area of the structure with increasing distance (depth) from the structure. Thus, the additional stress in the ground beneath the structure is reduced with depth to lessen the increase of the stress in a ground. Even if the structure is constructed to cause the increase of stress in a ground in excess of a value before the construction of the structure, the ground does not always start settlement until the stress in a ground reaches a certain value. The stress sufficient to start the settlement is called consolidation yield stress. In the geologically young ground, since the consolidation yield stress serving as the critical value for starting the settlement is approximately equal to the stress in a ground caused by the self-weight of the soil, the ground starts the settlement with slight additional stress. On the other hand, in the geologically old ground, since the consolidation yield stress is higher than the stress in a ground caused by the self-weight of the soil, the ground does not start the settlement with additional stress of a small magnitude in some cases.

Namely, the structure can be installed on the bottom of the water without settlement on condition that the stress in a ground after the construction of the structure is brought within a range of less than the consolidation yield stress of the ground according to some methods, or that some improvement method is applied to the ground in advance to increase the consolidation yield stress more than the stress in a ground after the construction of the structure. In particular, a combination of both the above conditions is the most effective.

When the water level varies at an installation place of the structure, the buoyancy is increased with the elevation of the water level, and therefore, the contact pressure is reduced. On the other hand, the contact pressure is increased with the drawdown. Thus, balance between the stress in a ground and the consolidation yield stress described above is varied. However, it is possible to cope with the variation of the balance by varying the quantity of water in the ballast tanks in accordance with the variation of the water level to hold the contact pressure of the structure constant, or by allowing sufficient difference between the stress in a ground and the consolidation yield stress of the ground such as to always satisfy the afore-mentioned conditions within the range of the variation of the contact pressure caused by the change of water level. In the following specification, the allowed contact pressure for the variation of the balance described above is called appropriate contact pressure, while the allowed consolidation yield stress for the variation of the balance described above is called appropriate consolidation yield stress.

As described above, the appropriate stress in a ground can be ensured by means of arbitrarily regulating the buoyancy acting on the structure provided with a plurality of ballast tanks capable of being charged with water or by excavating the ground together with the regulation of ballast. On the other hand, the appropriate consolidation yield stress can be ensured by means of slightly improving the ground or excavating the ground together with the ground improvement. The increase of the consolidation yield stress to an appropriate magnitude is attained by one of the soil improvement methods including a preloading method, a chemical solidifying method, a sand compaction pile method and so on, or by a combination of these methods, or together with the excavation of the ground.

The structure can be installed on the bottom of the water in the submerged state without sliding or like unstable behavior in the horizontal direction due to horizontal force such as waves on condition that the ground has the sufficiently large shear resistance at the installation place of the structure. The above condition is satisfied so far as the strength of the installation place of the structure is ensured by means of improving the ground or slightly excavating the ground together with the ground improvement, and the structure lands at the appropriate contact pressure on the ground at the installation place.

Since the structure is installed at the appropriate contact pressure on the water-bottom ground of appropriate strength, a base structure resists the external force caused by the wind, waves and tidal current with the frictional force acting on the ground at the installation place, and avoid sliding or rocking. On the other hand, similarly to the structure as disclosed in Japanese Patent Laid-open No. 4-85410, since the structure slides relatively to the surface of the ground at the installation place, or appropriate shearing deformation is caused in the subsurface part, the external force such as an earthquake is insulated from the structure with relatively small frictional force to reduce the input of external force to the structure. Thus, the structure can be singly stabilized and highly secured against the various kinds of turbulences to reduce the probability of troubles such as capsizing, settling and drifting to the minimum.

According to the present invention, as described above, the structure can be installed in the submerged state without settlement on condition that the ground is slightly improved in order to enhance the consolidation yield stress of the ground in advance, while the quantity of water in the ballast tanks is regulated to obtain the appropriate contact pressure. In the reclamation method, since the additional stress caused by the weight of earth and sand for reclamation, i.e., the contact pressure acting on the sea-bottom is extremely high and the stress in a ground largely exceeds the consolidation yield stress of the ground. The excessive amount of stress in a ground is equivalent to the pressure resulting from the sum of the weight of soil corresponding to the thickness from the bottom of the sea to the surface of the reclaimed land and the weight of soil corresponding to the thickness equivalent to the settlement of the sea-bottom surface in the reclamation step. Thus, the stress in a ground is still excessive even by deducting the buoyancy acting on the soil. As the countermeasure of this case, if the ground is improved in order to enhance the consolidation yield stress of the ground in advance, a great cost and a long period of time are inevitably required for the execution of works. Further, when a large area is reclaimed, a substantial stress increase extends up to a very deep stratum. Thus, even in the geologically old ground, the stress in a ground in the deep part exceeds the consolidation yield stress of the ground. However, it is impossible to improve the ground into the very deep part, and as a result, the large settlement continues for a long period of time.

On the other hand, irrespective of the depth of the installation place of the soft landing structure, the additional stress applied from the structure can be restricted to a minimum required value by regulating the ballast. Thus, the improvement of the ground only for slightly increasing the consolidation yield stress of the ground or the slight excavation of the ground together with the improvement is required. As a result, the cost of construction and the term of works are remarkably reduced, in comparison with the case of the improvement of the ground according to the reclamation method. Further, it is possible to avoid the long-term settlement of the deep soil stratum by controlling the contact pressure not to exceed the consolidation yield stress in the deep part of the geologically old ground.

According to Japanese Patent Laid-open No. 4-85410, the bottom of the water is excavated, and the ballast is regulated to control the contact pressure of the structure to be smaller than the pressure caused by the own weight of excavated soil, whereby the stress in a ground at the depth deeper than the excavated bottom is prevented from increasing to thereby satisfy the condition that the stress in a ground does not exceed the consolidation yield stress. However, when it is conceivable that the excavated-bottom ground strength thus determined is insufficient for resisting the horizontal force acting on the structure, or when the water level largely varies, the bottom of the water should be excavated deeper than the level of excavation required for preventing the settlement. As a result, the structure is unnecessarily made higher to lead to the increase of the cost of construction in some cases. On the other hand, according to the present invention, since the strength of the ground can be enhanced together with the improvement of the ground for enhancing the consolidation yield stress of the ground, the conditions of the ground can be freely improved in advance, inclusive of the stability of the structure secured against the horizontal force. Thus, it is not necessary to excavate the bottom of the water, or only the slight excavation is required.

A soft landing structure (which will be hereinafter referred to simply as structure or SLS) 1 (or 3 or 4: the reference numeral corresponds to that in the drawings) constructed on the bottom of the water in the landing state at the appropriate contact pressure is a structure which is partly or mostly submerged under the water and installed on the bottom of the water in the landing state. The structure (SLS 1, 3 or 4) comprises ballast tank(s) capable of being charged with water and freely regulating the quantity of water.

The horizontal stability of the structure (SLS 1 or 3) in the floating state before landing and in the landing state can be ensured by a plurality of ballast tanks arranged in each of two horizontal directions.

The basic structure (single SLS 1 or 3 or a combination of SLS 1 and SLS 3: hereinafter will be referred to as SLS 1 and/or SLS 3) lands on the bottom of the water to constitute a lower structure, and an upper structure projecting from the surface of the water is mounted on the lower structure, whereby a structure capable of having production functions, housing facilities or the like is constructed.

A plurality of basic structures (SLS 1) or structures (SLS 3) each mounted with the upper structure are connected in the aggregate state to constitute an artificial island having high capability of accommodating various facilities. In particular, when the basic structures (SLS 1 and/or SLS 3) are connected in plane to extend in one or two directions, the structures (SLS 1 and/or SLS 3) are freely connected to or separated from each other. Thus, after the structures have been assembled into the artificial island, it is possible to arbitrarily enlarge or reduce the scale of the artificial island. Therefore the structures are suitable for the construction of various infrastructures including the production functions or the like, as the structures having various purposes. Furthermore, when a plurality of structures are connected annularly to constitute an artificial island having an inside calm water area enclosed thereby, such an enclosed water area can be used for various purposes.

When the structures (SLS 1 and/or SLS 3) are combined in plane in parallel crosses or annularly, the water area for installation of the structure (SLS 4) is divided into the inside and outside water areas. In this case, the inside calm water area can be used for ocean ranches, marine recreation facilities or the like. In particular, when the structures are connected annularly in a closed state, and when the water level of the inside water area enclosed by the closed structure (SLS 4) is set to be lower than the water level of the outside water area of the structure (SLS 4), force (hoop compression) is introduced to the mutually adjacent basic structures (SLS 1 or 3) to bring the structure into contact with the adjacent structure. Similarly, when the inner peripheral surfaces of the structures (SLS 1 or SLS 3) are continuously connected in a circle, and when the water level of the inside water is set to be lower than the outside water, force (arching) is introduced to disperse the external force such as water pressure in the circumferential direction. Due to these introduced forces, the stability of the structure (SLS 4) against the external force can be further enhanced.

A description will now be given of an installation method of the structure (SLS 1, 3 or 4).

The structure (SLS) can be tugged in the floating state to a candidate place for installation of the structure (SLS) on condition that the structure takes a shape sufficient to obtain the buoyancy corresponding to the total weight of the structure (SLS) when submerged in the water to a predetermined depth, and that the water area adapted to tug the structure is deeper than the predetermined depth. On the other hand, the structure can be installed on the bottom of the water, i.e., the structure is prevented from floating up to the surface on condition that the total weight of the structure (SLS) is greater than the buoyancy acting on the structure (SLS) at the depth of the installation place of the structure. Both the above conditions are satisfied with the same structure (SLS) on condition that the structure has a plurality of ballast tanks capable of being charged with water to arbitrarily adjust the buoyancy acting on the structure (SLS).

One method of installing the soft landing structure (SLS1), or the soft landing structure (SLS 3) composed of the lower structure constructed by the structures (SLS 1), and an upper structure mounted on the lower structure is executed as follows. Namely, the water-bottom ground is improved or slightly excavated together with the ground improvement such that the ground has the required appropriate consolidation yield stress in excess of the stress in a ground applied at the time of accomplishing the installation of these structures (SLS 1 and/or SLS 3). On the other hand, the structures (SLS 1 and/or SLS 3) are constructed on the land or water and then tugged to the candidate water area for installation or constructed in the candidate water area for installation, and then land on the bottom of the water by charging the ballast tanks with water, while the quantity of water in the ballast tanks is regulated such as to reach the appropriate contact pressure.

One process of installing the structure (SLS 3) composed of the lower structure and the upper structure mounted on the lower structure is executed as follows. Namely, the water-bottom ground is improved or slightly excavated together with the ground improvement such that the ground has the required appropriate consolidation yield stress in excess of the stress in a ground applied at the time of accomplishing the installation of the structure (SLS 3). On the other hand, the part or whole of the lower structure or the lower structure mounted with the part of the upper structure is constructed on the land or water and then tugged to the candidate water area for installation or constructed in the candidate water area for installation, and then once lands on the bottom of the water by charging the ballast tanks with water. Thereafter, the remaining structure is constructed to accomplish the installation of the basic unit in the landing state on the bottom of the water, while the quantity of water in the ballast tanks is regulated to maintain the appropriate contact pressure. The structure (SLS 4) composed of the plurality of structures (SLS 3) can be also constructed by repeatedly carrying out the above procedure.

One process of installing the soft landing structure (SLS 4) composed of the plurality of structures (SLS 1 and/or SLS 3) connected is executed as follows. Namely, the water-bottom ground is improved or slightly excavated together with the ground improvement such that the ground has the required appropriate consolidation yield stress in excess of the stress in a ground applied at the time of accomplishing the installation of the structure (SLS 4). On the other hand, the structures (SLS 1) serving as the lower structure, or the part or whole of the structures (SLS 3) are constructed on the land or water and then tugged to the candidate water area for installation or constructed in the candidate water area for installation, then connected as keeping afloat by means of regulating the quantity of water in the ballast tanks, and subsequently once land on the bottom of the water by charging the ballast tanks with water. Thereafter, the remaining structure is then constructed to accomplish the installation of the structure (SLS 4) in the landing state on the bottom of the water, while the quantity of water in the ballast tanks is regulated to maintain the appropriate contact pressure.

The method of execution of works according to the present invention is different from the conventional reclamation method or the like in that the natural water-bottom ground is only partially improved, i.e., the almost the water-bottom ground is used as it stands, while the lower structure submerged in the water is constructed as unit on the land or water in advance. Thus, according to the present invention, after the structure has been installed on the bottom of the water, the remaining part of the structure is successively constructed on the water and therefore, the number of steps of execution of works is reduced as a whole. Besides, the execution of works in the construction field is simplified to thereby permit the saving of the cost of construction and the reduction of the term of works of against the scale of the structure in the water area.

Further, the structures (SLS 1 and/or SLS 3) are constructed in a dock on the land or water and installed in the water area such as to land on the bottom of the water. Thus, when the structures (SLS) are no longer safe to use or completely fulfill its duties, the structures are disassembled according to steps reverse to the execution steps and then removed to restore the construction field to the former condition. Therefore, it is possible to preserve the environment in the vicinity of the installation place without damaging the environment after the accomplishment of construction of the structure, inclusive of the period under construction.

DESCRIPTION OF THE PREFERRED EMBODIMENT

Figure 1:
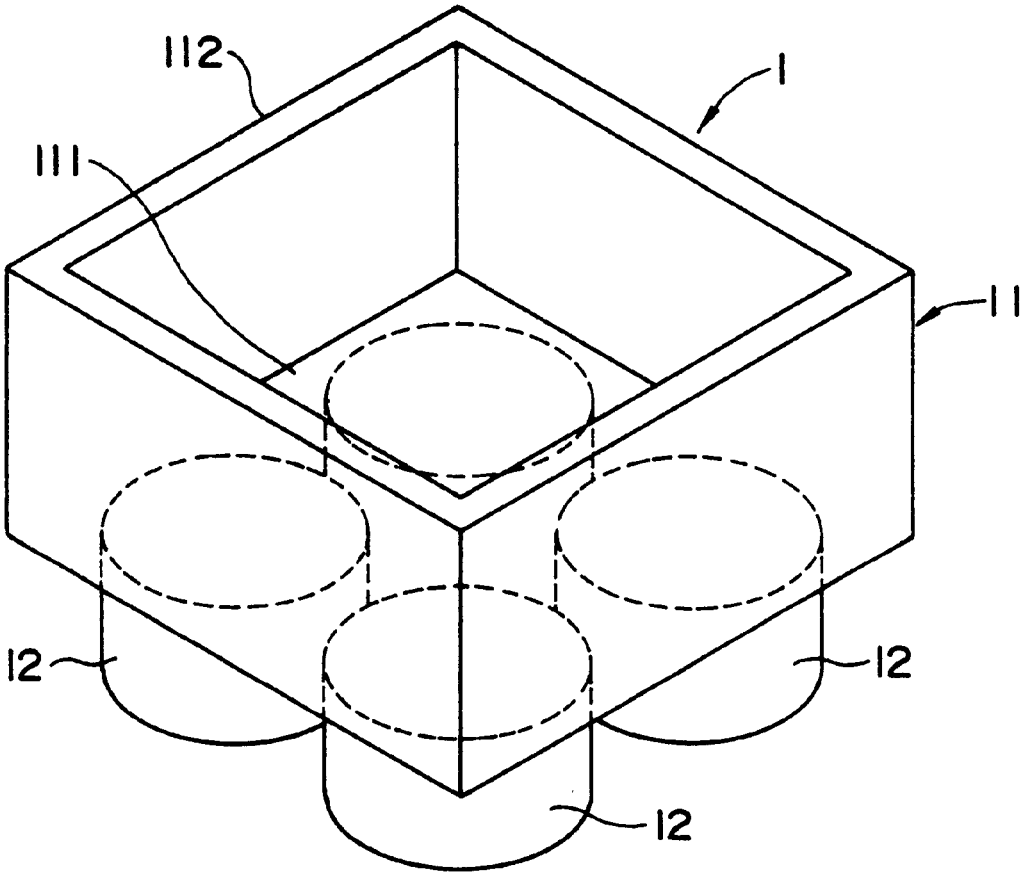
FIG. 1 is a perspective view showing SLS 1 of a type, which can be installed in the water area of large depth as against the size of a space to be submerged in the water, and also characteristically showing a function of ballast.
Figure 24:
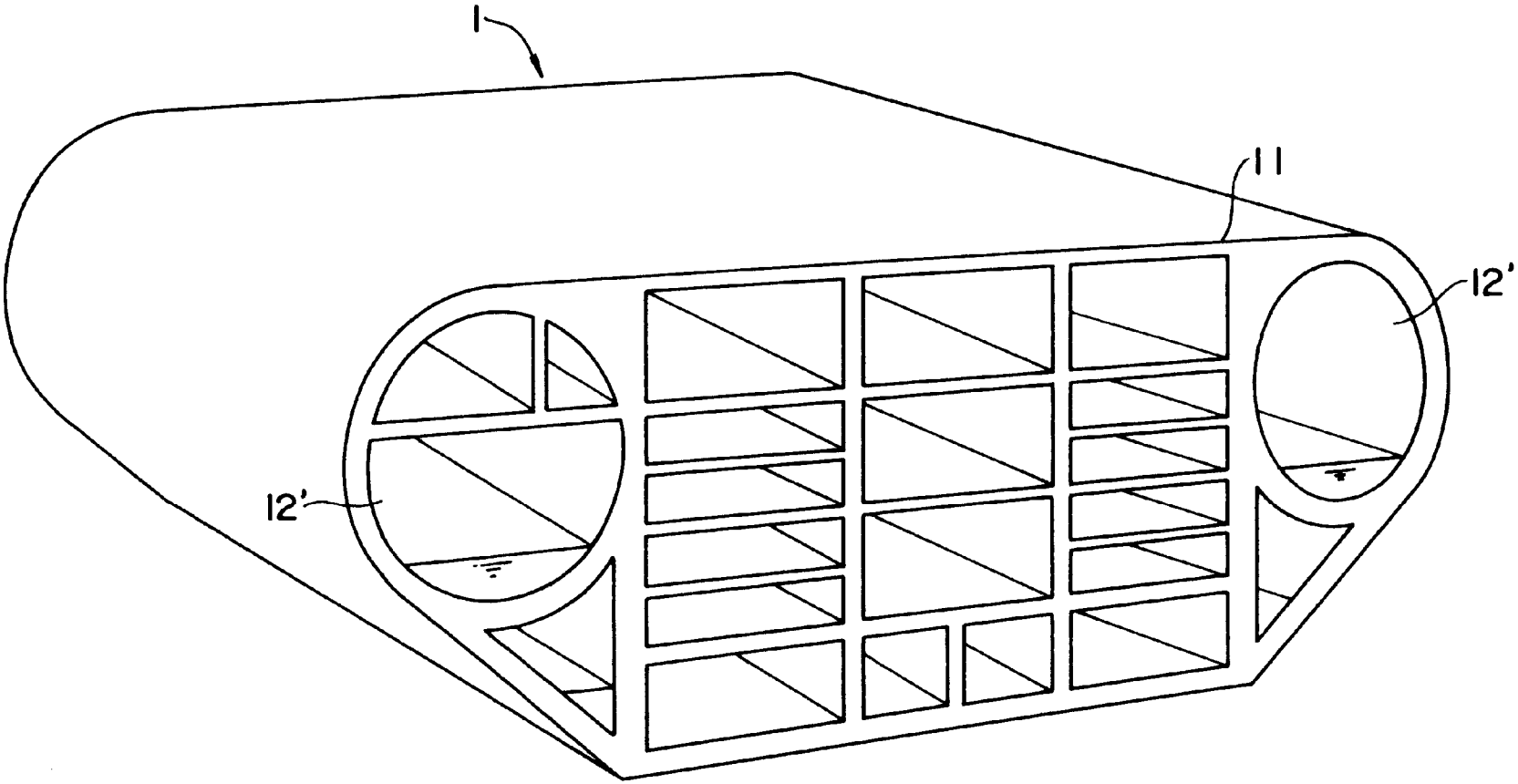
FIG. 24 is a perspective view showing SLS 1 of a type, in which ballast tanks are incorporated in a structural body.

FIGS. 1 and 24 illustrate a soft landing structure 1 (which will be hereinafter referred to as SLS 1) of the present invention. In case where SLS 1 is installed in a water area of small depth and an available space in the structure should be ensured down to the foundation on the bottom of the water, SLS 1 is basically constructed as shown in FIG. 24. SLS 1 in this case comprises a space 12' for each ballast tank (which will be hereinafter referred to as ballast tank) incorporated in the structure together with an available space, and the ballast tank 12' is capable of being charged with water and also freely regulating the quantity of water.

Figure 2:
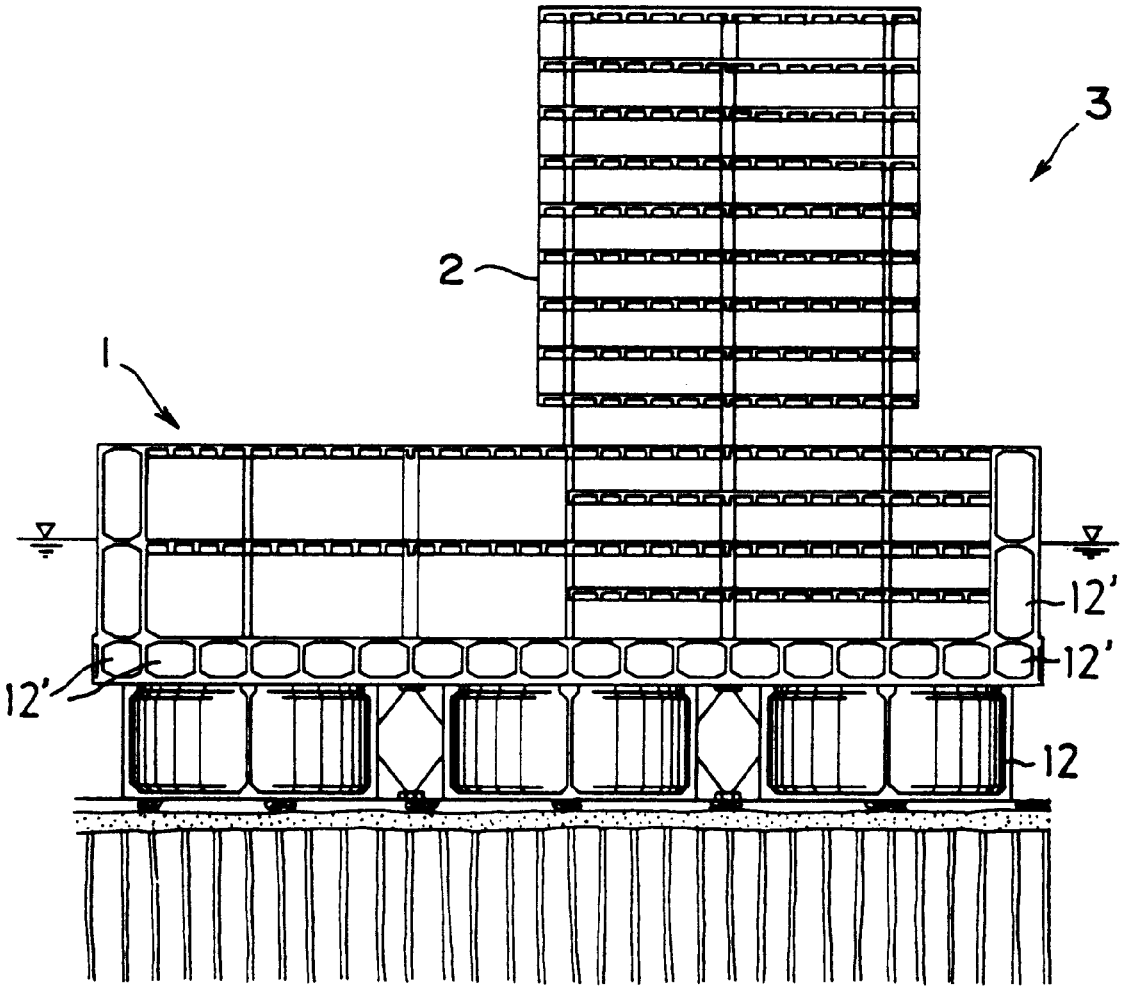
FIG. 2 is a sectional view showing the state of SLS 3 installed by using a single SLS 1 shown in FIG. 1.

On the other hand, in case where SLS 1 is installed in a water area of large depth and has enough available space, SLS 1 is basically constructed as shown in FIG. 1. SLS 1 in this case comprises ballast tanks 12 arranged on the lower part of SLS 1 and a structural body 11 containing the available space and arranged on the ballast tanks. The ballast tank 12 has only a function of ballast capable of being charged with water and also freely regulating the quantity of water. SLS 1 in the latter case may also comprise the ballast tanks 12' incorporated in the structural body 11 at need, as shown in FIG. 2.

SLS 1 comprises the ballast tanks 12, 12' capable of being charged with water and also freely regulating the quantity of water, and is installed on the bottom of the water in the landing state, without floating up to the surface due to the buoyancy, nor settling due to the consolidation of the ground, by means of improving the water-bottom ground or slightly excavating the ground together with the improvement of the ground, while regulating the quantity of water in the ballast tanks 12, 12'. Thus, SLS 1 can be constructed as a stationary structure in the water area.

SLS 1 of the present invention according to claim 2 comprises a plurality of ballast tanks 2 arranged in each of two horizontal directions in order to attain stability in two horizontal directions particularly in the floating state and the landing state of SLS 1. FIG. 1 shows SLS 1 as a minimum unit which satisfies the above requirements. In the following, SLS 1 comprises the invention according to claim 1 and that according to claim 2.

SLS 1 serves as the minimum unit of a soft landing structure 3 (which will be hereinafter referred to as SLS 3) that is composed of SLS I and an upper structure 2 constructed on SLS 1, and serves as the minimum unit of a soft landing structure 4 (which will be hereinafter referred to as SLS 4) composed of a combination of SLSs 3.

SLS 3 of the present invention is composed of the lower structure constructed by SLS 1 and the upper structure 2 constructed on SLS 1. SLS 3 is installed on the bottom of the water under the condition that the quantity of water in each of the ballast tanks 12, 12' is regulated such that the total own weight of SLS 3 including the weight of SLS 1, that of the upper structure 2 and that of water as the ballast is greater than the buoyancy of SLS 3 in the landing state, that SLS 3 in the landing state does not cause the settlement of ground even if the buoyancy varies, and that SLS 3 is installed in the landing state at appropriate contact pressure enough to withstand the deformation caused by horizontal force. FIG. 2 shows an embodiment of SLS 3 constructed using SLS 1 shown in FIG. 1.

SLS 4 of the present invention is basically composed of SLS 1 according to claim 1 or 2 or SLS 3, wherein a plurality of SLSs 1 or 3 are combined and connected in one or two directions. FIGS. 3 to 5 and 13 show an embodiment of SLS 4 thus constructed. As described later, SLS 4 of the present invention is conceptionally comprised in SLS 4.

SLS 1 comprises a single ballast tank 12 arranged in the center in plane or a plurality of ballast tanks 12 arranged uniformly in each of two horizontal directions, as shown in FIG. 1. Even in case where a single SLS 1 comprises a single ballast tank 12, as long as the inside of the ballast tank is divided through partition walls into a plurality of spaces, the single ballast tank 12 in this case is worth a plurality of ballast tanks 12. The number of ballast tanks 12 and the positional relation between the ballast tanks 12 and the structural body 11 are determined depending on how to use SLS 3 including the upper structure 2 or SLS 4 composed of SLS 3 as the structure.

A description will now be given of the constitution of SLS 4 based on SLS 1 shown in FIG. 1.

The structural body 11 of SLS 1 is built in reinforced concrete construction (including precast concrete construction), steel structure or a composite structure of both the reinforced concrete construction and the steel structure. The ballast tank 12 is built similarly to the structural body or by covering a steel shell with concrete.

SLS 1 shown in FIG. 1 is manufactured as follows. Namely, the required number of ballast tanks 12 for the regulation of buoyancy are connected through connecting members 13 as shown in FIGS. 3 and 4, and the structural body 11 is constructed on the ballast tanks 12.

Figure 5:
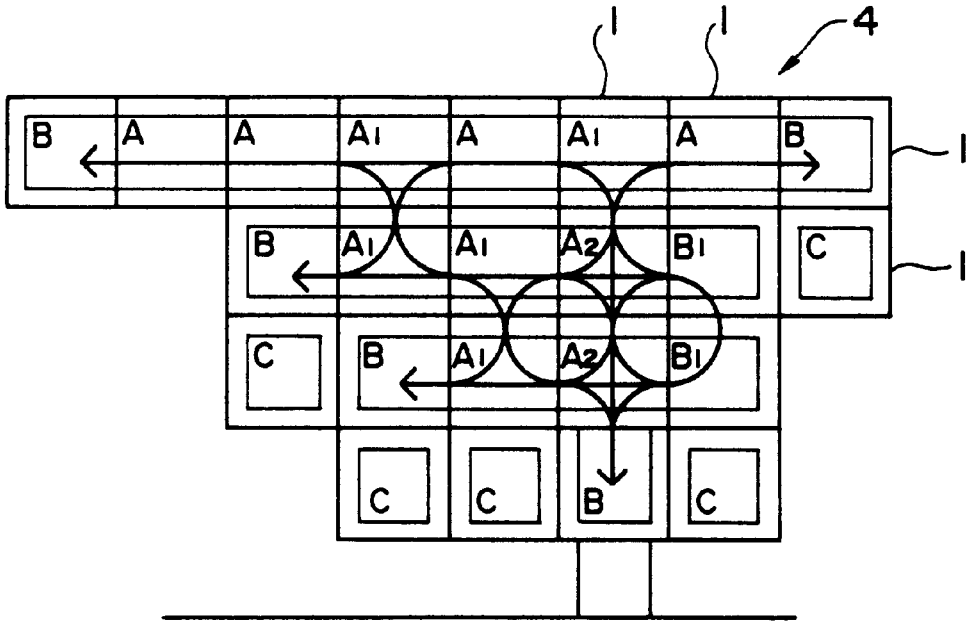
FIG. 5 is a plan view showing SLS 4 having an available space resulting from connecting the space of each SLS 1 of FIG. 1.
Figure 6:
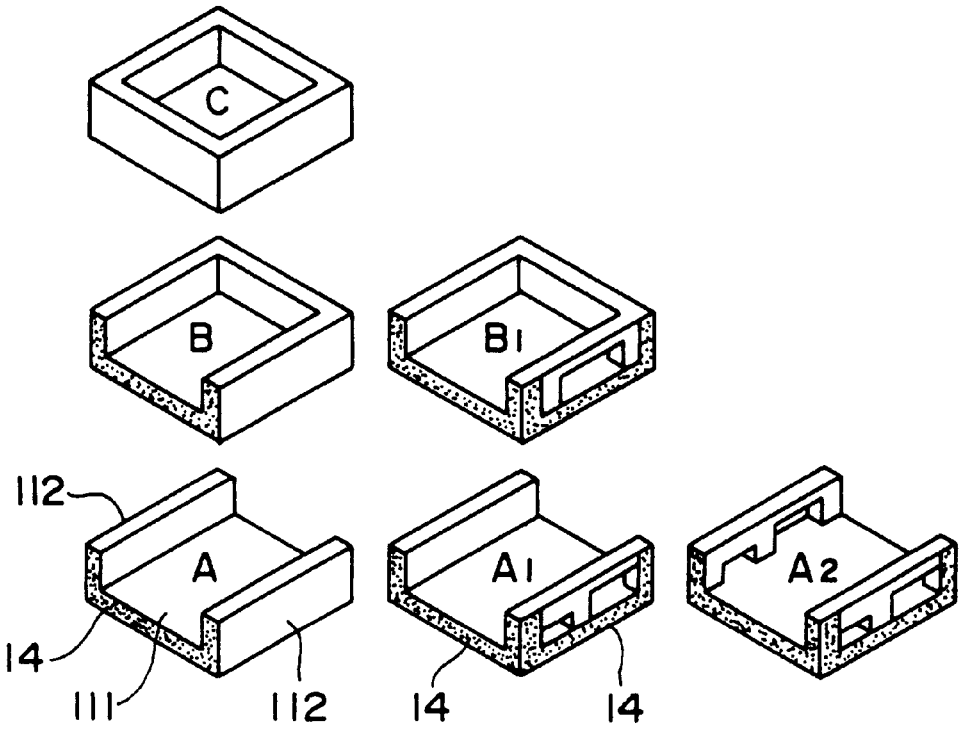
FIG. 6 is a schematic view showing the characteristics of a variety of SLSs 1 used for SLS 4 of FIG. 5.
Figure 7:
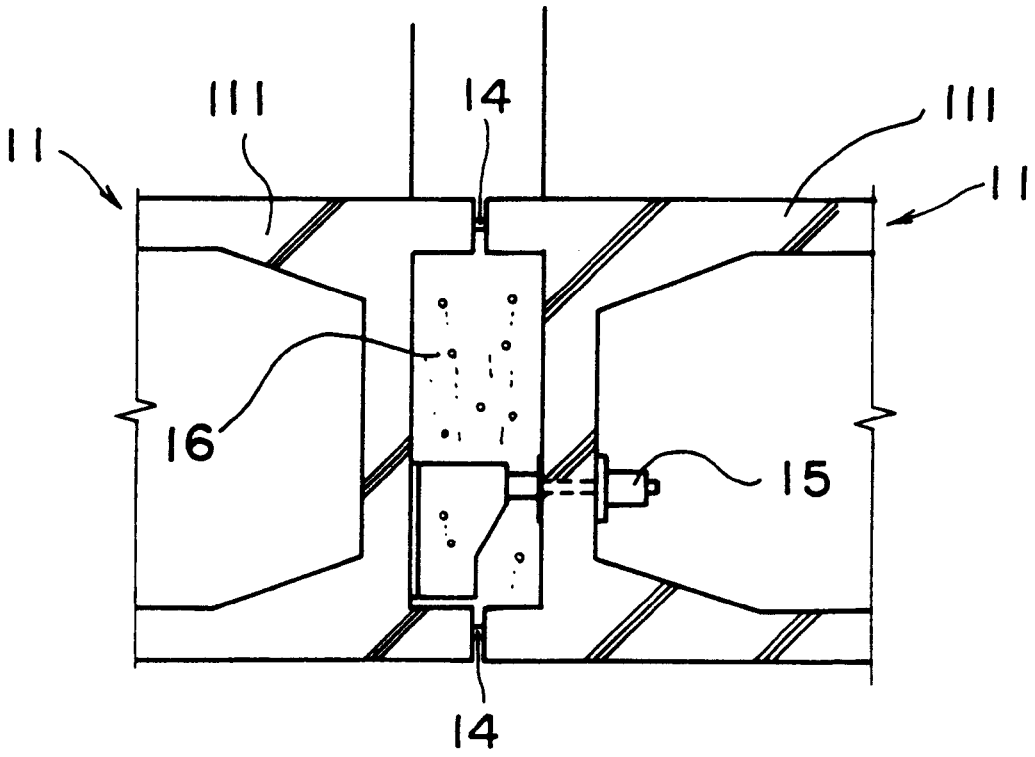
FIG. 7 is a sectional view showing the connection of structural bodies of the mutually adjacent SLSs 1.

A plurality of SLSs 1 are connected at portions of the structural bodies 11, 11 as shown in FIG. 7 to constitute SLS 4, in which a planar shape freely extendible in one or two directions as shown in FIG. 5. FIG. 6 shows patterns of SLS 1 constituting SLS 4 shown in FIG. 5. Incidentally, when it is not necessary for SLS 4 to connect the spaces under the surface of the water, the plurality of SLSs 1 can be connected at portions of the upper structures 2, 2.

The structural body 11 of SLS 1 shown in FIG. 1 is composed of a bottom plate 111 and side walls 112. As shown in FIG. 6, the side wall 112 is partially cut at a contact portion between the mutually adjacent SLSs 1, 1 or not required in dependence on the position of SLS 1 in plane, corresponding to the traffic line in the internal space or how to use the space. Six patterns of SLS 1 shown in FIG. 6 are arranged at positions in FIG. 5 designated by reference symbols corresponding to those of the patterns. A water sealing belt 14 is laid on butted surfaces of the structural bodies 11, 11 of the mutually adjacent SLSs 1, 1 to cut off water. Further, since the structural body 11 itself is composed of the bottom plate 111 and the side walls 112 to take the shape of a box, SLS 1 is structured to resist water pressure applied from the periphery. Thus, the inside space and the upper structure 2 are constructed without taking the influence of external force into consideration.

Figure 3:
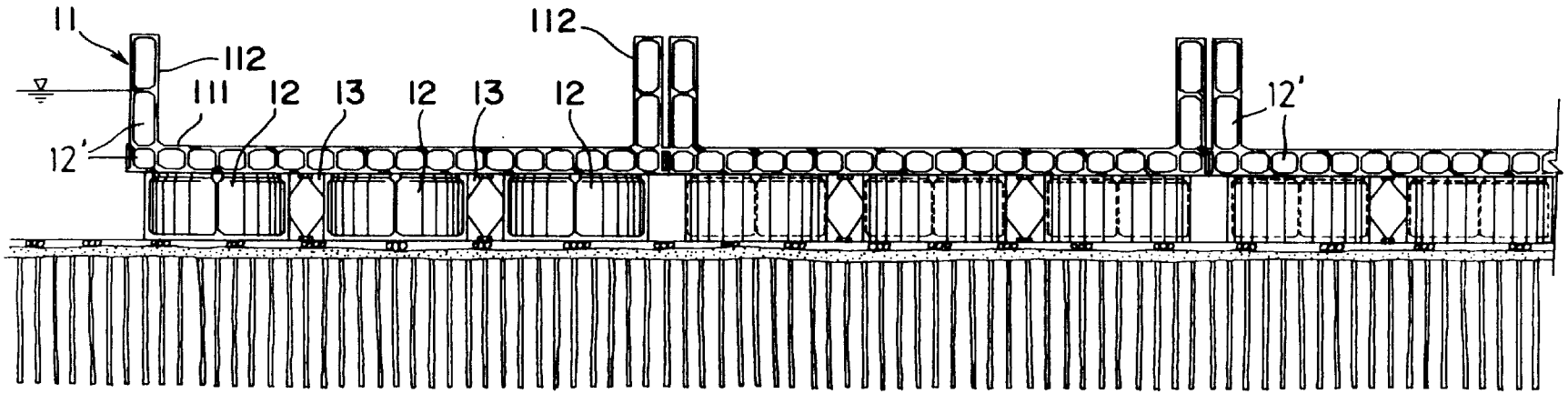
FIG. 3 is a sectional view showing the state of SLS 4 installed by connecting a plurality of SLSs 1 of FIG. 1.
Figure 4:
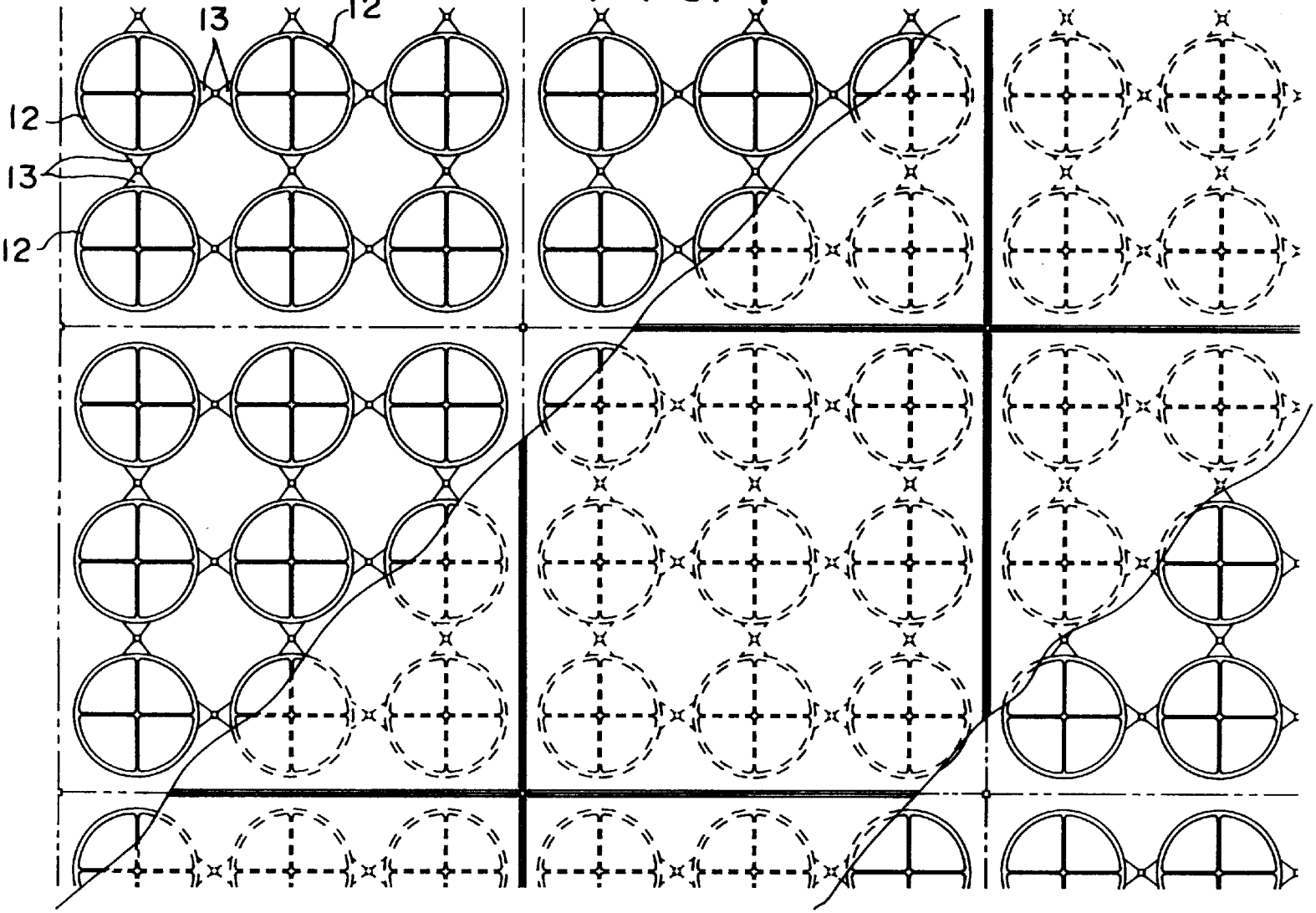
FIG. 4 is a plan view of FIG. 3.

FIG. 7 is a partially enlarged-scale view of FIG. 3 and illustrates a connection portion between the structural bodies 11, 11 of the mutually adjacent SLSs 1, 1. As shown in FIG.

7, both the structural bodies 11, 11 are connected to enable the transmission of tensile force and compressive force through a tension member 15 for bearing tensile force and concrete 16 charged between both the structural bodies. In this connection state, it is possible to prevent the disordered behavior between the mutually adjacent SLSs 1, 1. Water pressure exerting to maintain the connected state normally acts from the periphery so as to mutually butt the continuously-arranged SLSs, and tensile force exerting to release the connected state acts due to waves and strong wind or the like so as to separate the continuously-arranged SLSs from each other. However, in the connection portion according to the present invention, the concrete 16 resists the water pressure, and the tension member 14 resists the tensile force.

A description will now be given of the outline in execution or works from the connection to the landing of SLS 4 composed of a plurality of SLSs 1 with reference to FIGS. 8 to 12 respectively showing the execution of works in case of using SLS 1 shown in FIG. 1.

Figure 8:
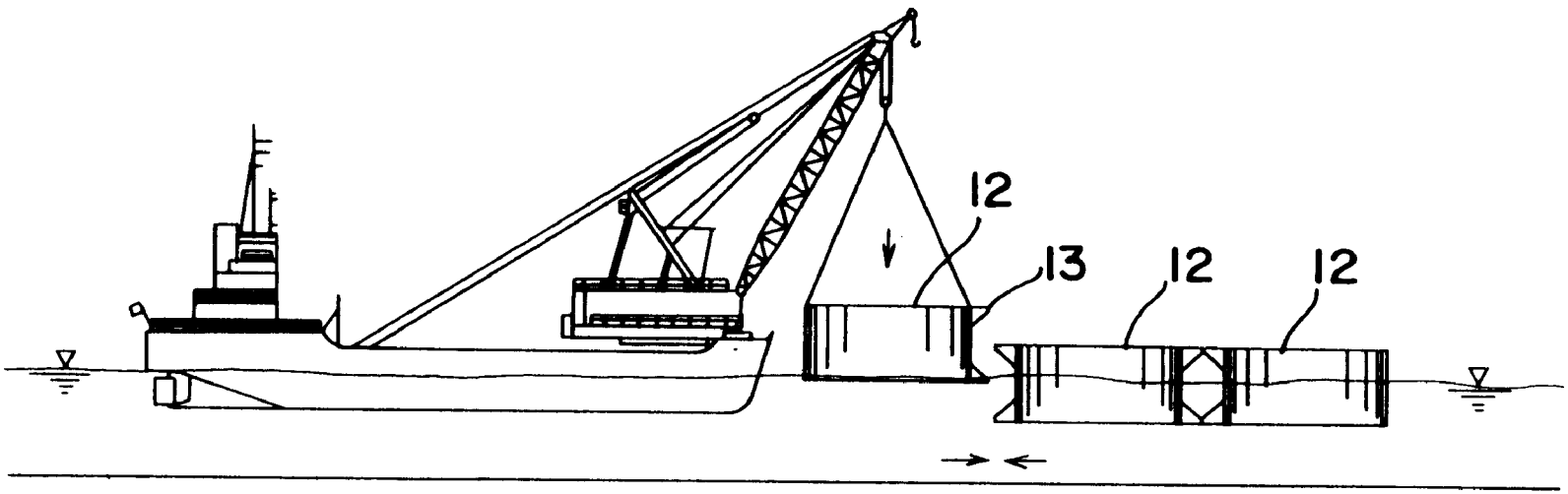
FIG. 8 exemplifies the method of connection of a plurality of ballast tanks of the SLS 1 of FIG. 1 on the water.
Figure 9:
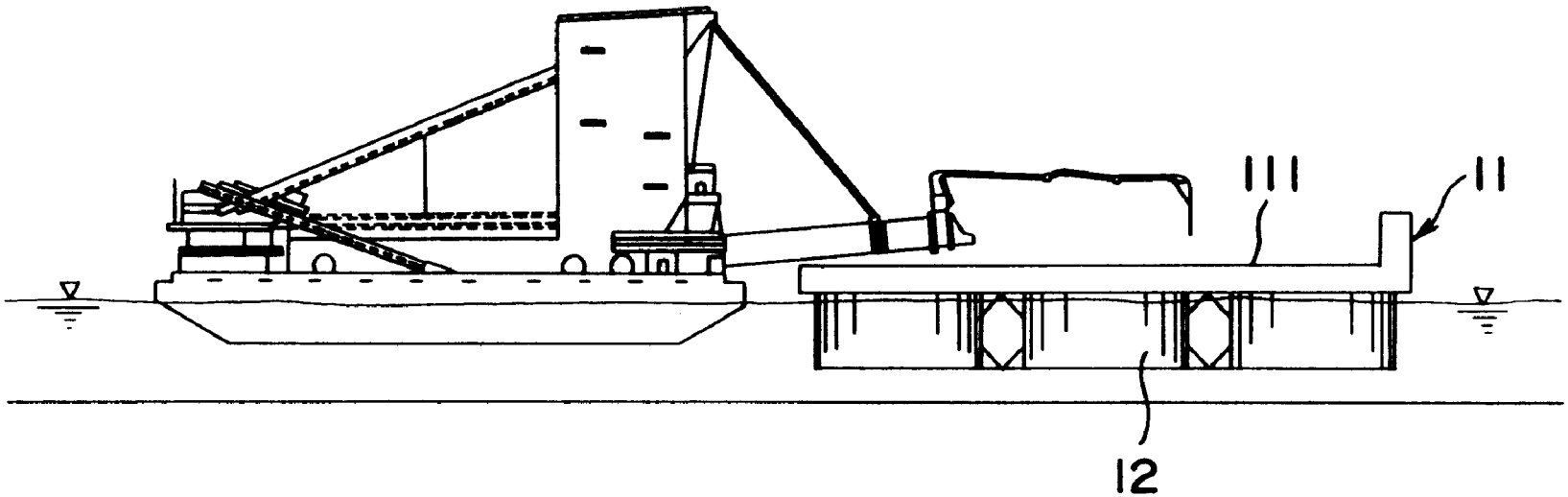
FIG. 9 exemplifies the construction of the structural body on the plurality of connected ballast tanks shown in FIG. 8.

SLS 1 shown in FIG. 1 can be tugged to the candidate water area for installation after having been completely constructed in an appropriate dock or the like on land. Alternatively, the ballast tanks 12, 12 can be connected in the floating state in the calm water area or the candidate water area for installation as shown in FIG. 8 and then once installed on the bottom of the water in the landing state for the construction of the structural body 11. Otherwise, the structural body 11 can be constructed on the ballast tanks 12 in the floating state, as shown in FIG. 9.

Figure 11:
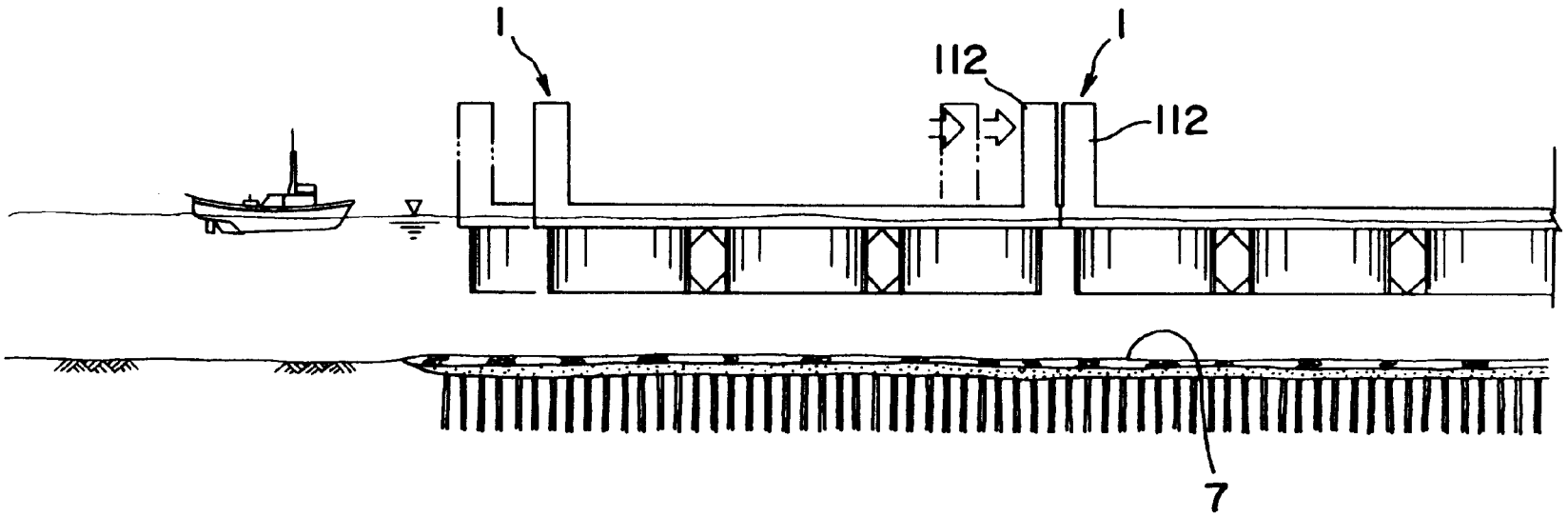
FIG. 11 is an elevation showing the state of SLSs 1 connected on the water.

The plurality of SLSs 1 can be connected after independently having landed. Alternatively, the plurality of SLSs 1 can be connected in the floating state, as shown in FIG. 11.

Figure 12:
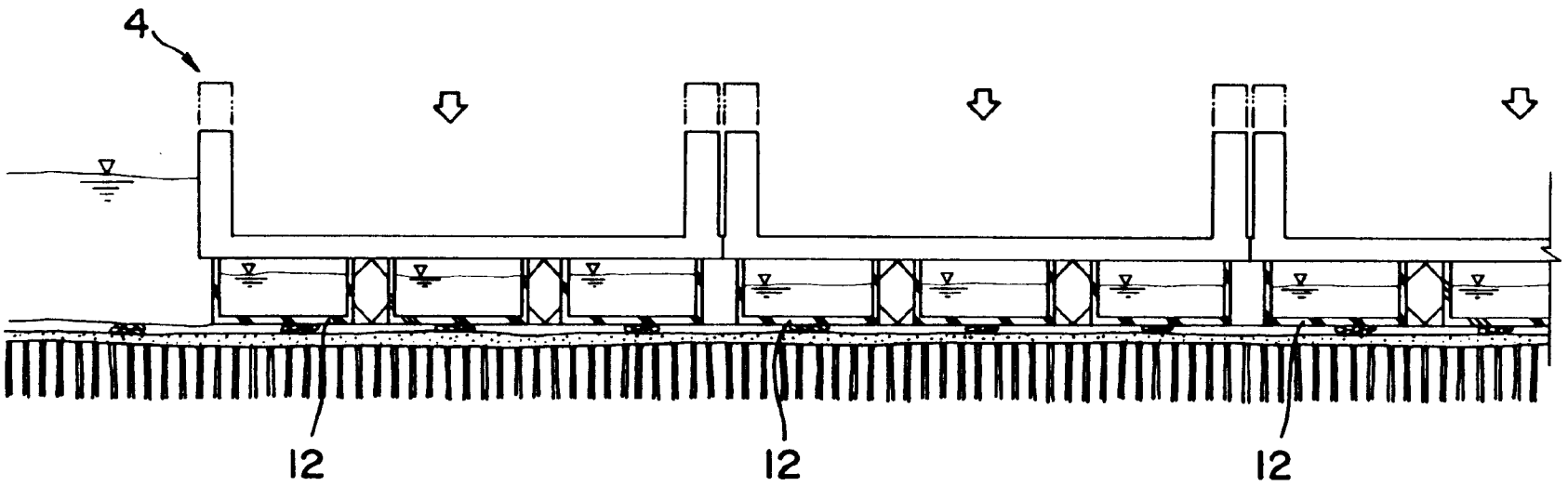
FIG. 12 is an elevation showing the state of SLS 4 of FIG. 11 when landing.
Figure 13:
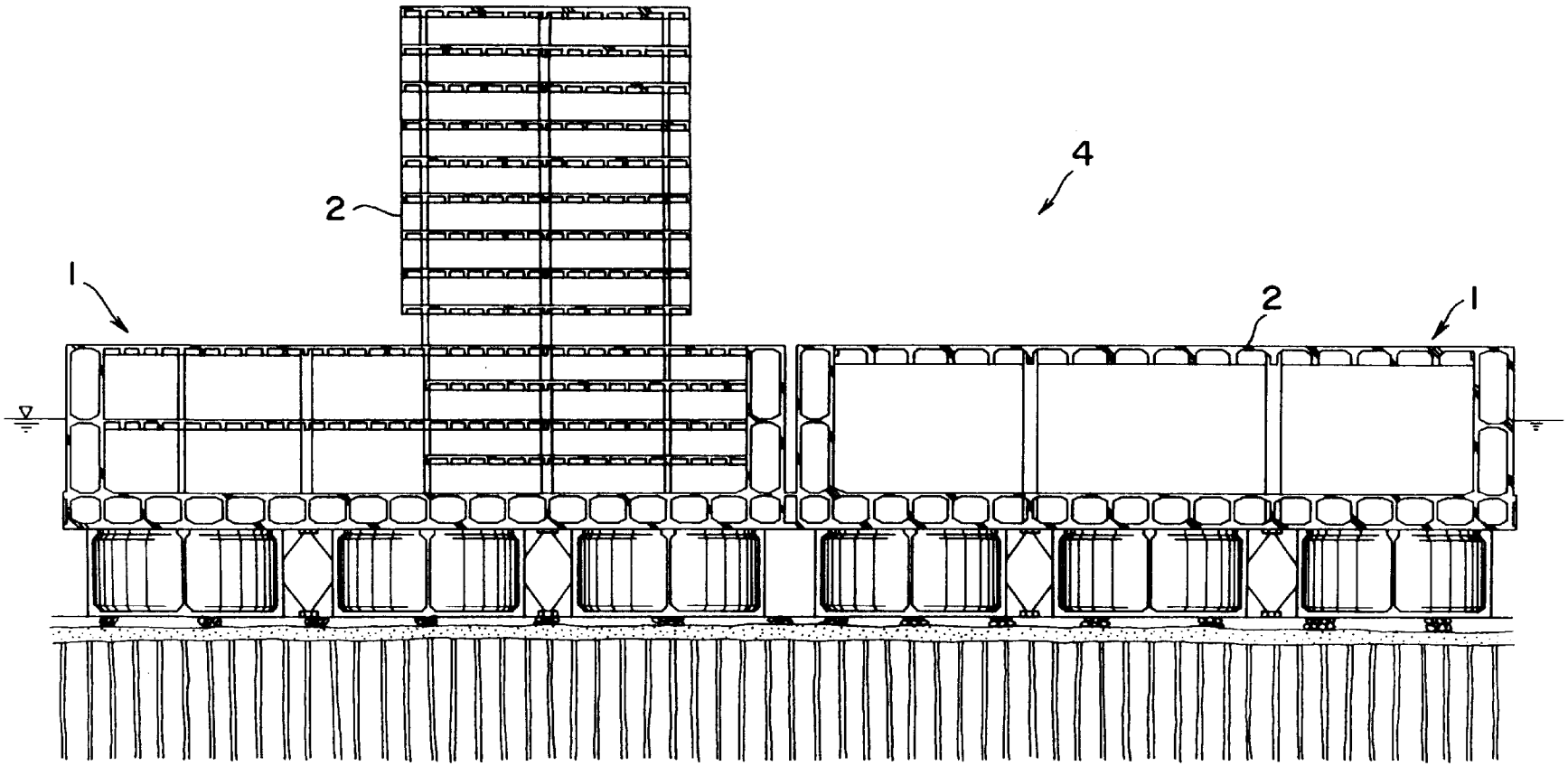
FIG. 13 is an elevation of an upper structure constructed on SLS 1.

SLS 1 is submerged in the water independently or in block by charging each ballast tank 12 with water, and then lands in the mutually connected state, as shown in FIGS. 12 and 3. The quantity of water in the ballast tanks 12 of SLS1 at the time of landing is regulated such that the total weight of SLS 1 as the unit including the weight of water is greater than the buoyancy of SLS 1 in the landing state, that SLS 1 in the landing state does not cause the settlement of ground even if the buoyancy varies, and that SLS 1 is installed on the bottom of the water in the landing state at appropriate contact pressure enough to withstand the deformation caused by horizontal force.

On the other hand, the appropriate consolidation yield stress or strength required for the water-bottom ground can be attained by means of improving the water-bottom ground or slightly excavating the ground together with the ground improvement. The ground is improved according to a displacement method or a mixing method of miixing a chemical stabilizer, in addition to a compaction method normally executed for poor subsoil for bearing a land structure, a dewatering method or a coagulation method, or a combination of these methods.

Figure 10:
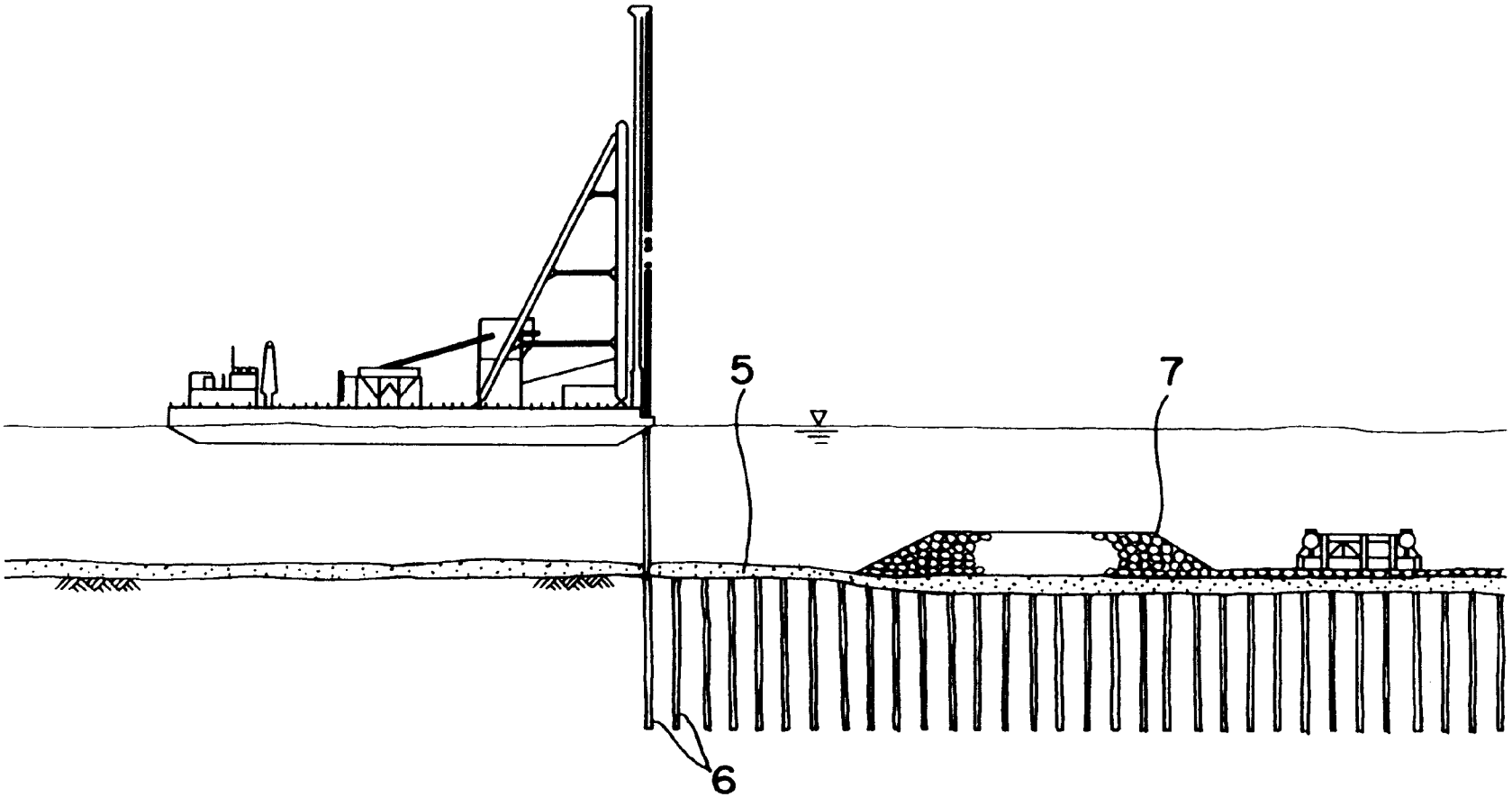
FIG. 10 is an elevation showing how to improve the water-bottom ground.

FIG. 10 shows a sand drain method, in which a sand mat 5 is laid on the candidate bottom of the water for installation of the soft landing structure, while sand piles 6 are formed, and earth and sand or rubble-mound 7 are laid on the sand mat 5 to apply a load to the bottom of the water. However, according to the present invention, the ground is improved more slightly, in comparison with a case of improving the ground according to a reclamation method or the like, since the contact pressure applied from the structure to the bottom of the water is restrained to the irreducible minimum of appropriate value by means of regulating the weight of water as the ballast, as will be later described. The ground is improved according to other methods described above as well. The method of improving the ground is arbitrarily selected depending on the conditions of soil on the bottom of the water. In case of FIG. 10, after the rubble-mound 7 in the leveled state has been allowed to stand for a required period, the improvement of the ground is accomplished.

Figure 16:
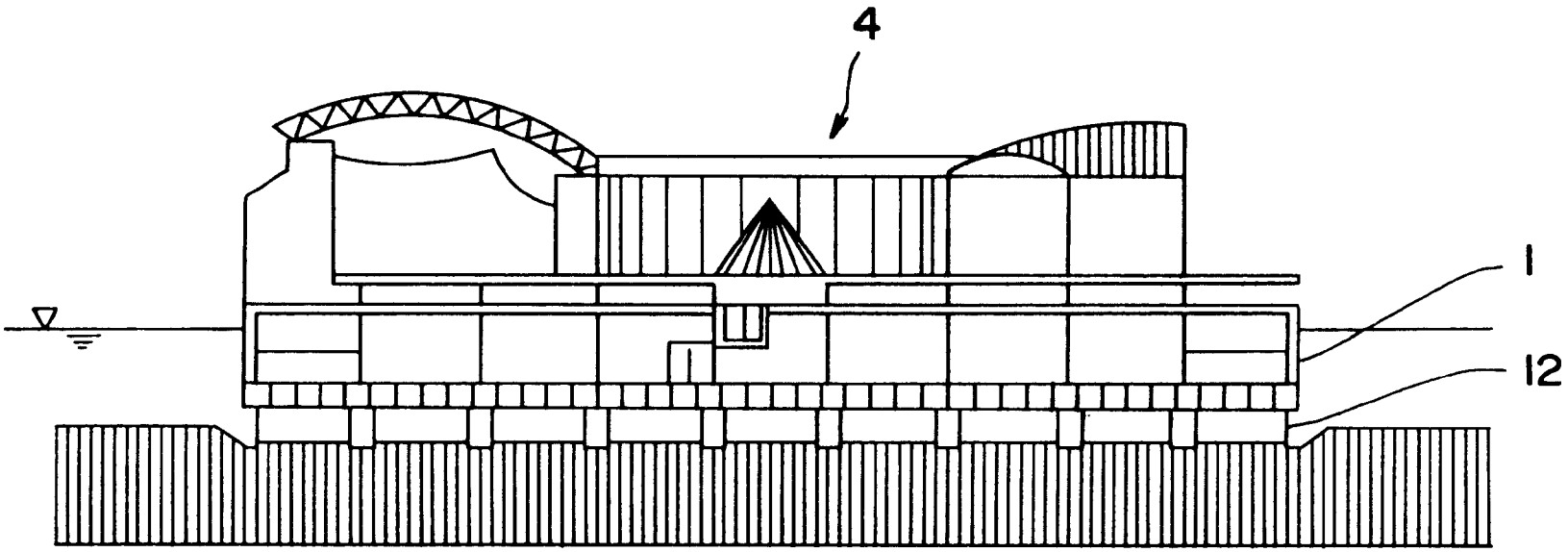
FIG. 16 is a sectional view showing the construction of SLS 4 when the water-bottom ground is slightly excavated.
Figure 17:
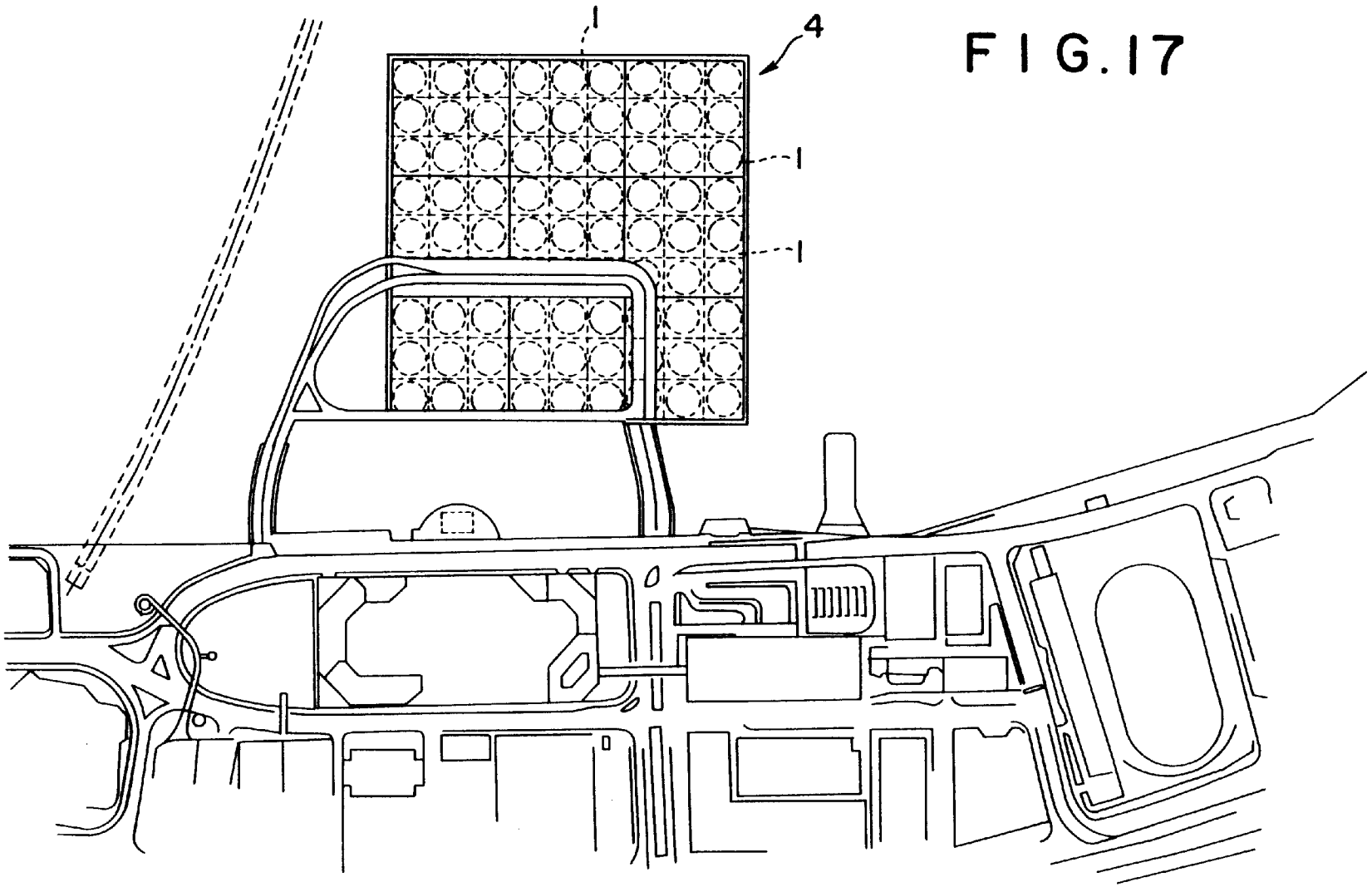
FIG. 17 is a plan view of FIG. 16.

The appropriate consolidation yield stress or strength required for the water-bottom ground is also ensured by means of auxiliarily executing the partial excavation of the ground or driving of the piles together with the improvement of the ground, in addition to the methods described above. In this case, the ground is partially excavated or the piles are driven after the improvement of the ground. However, such partial excavation or driving of the piles are supplementary works and hence, are executed more slightly, in comparison with a case of execution of works on land. Further, it is not necessary to excavate the ground to such a degree that the method disclosed in Japanese Patent Laid-open No. 4-85410 is independently performed. FIGS. 16 and 17 show the construction of the soft landing structure 4 in case of slightly excavating the bottom of the water.

Figure 18:
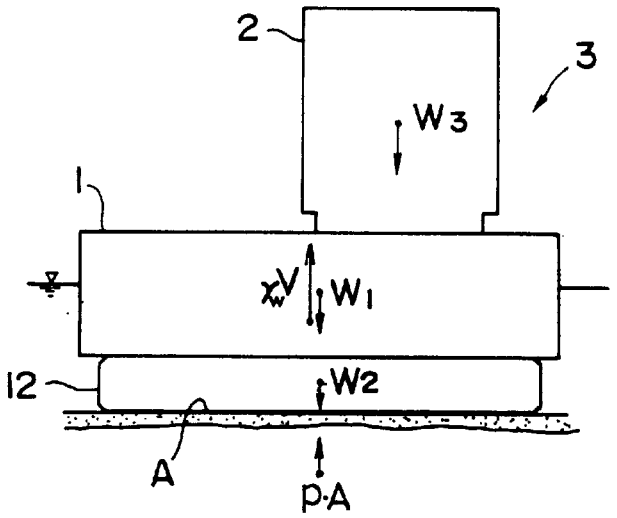
FIG. 18 is a schematic view showing the relation among the load of each part, the buoyancy and the contact pressure when SLS 3 is installed in the landing state.

The range of contact pressure between SLS 3 in landing and the bottom of the water is set so as to satisfy the following conditions (See FIG. 18).

The contact pressure between the water-bottom ground and SLS 3 composed of SLS 1 and the upper structure 2 constructed on SLS 1 is expressed by a quotient found by dividing $[(W_1+W_2+W_3)-\gamma_w \cdot V]$ by A wherein $(W_1+W_2+W_3)-\gamma_w \cdot V$ represents the difference between the sum $(W_1+W_2+W_3)$ of the total weight $W_1$ of SLS 1 itself serving as the lower structure, the weight $W_2$ of water charged in the ballast tanks 12 mounted on SLS 1 and the total weight $W_3$ of the upper structure 2, and the buoyancy $\gamma_w \cdot V$ acting on a submerged portion of SLS 3 in the landing state, and A represents the area under installation of SLS 1. SLS 3 can be prevented from floating up to the surface on condition that the quotient thus obtained is positive irrespectively of a variation of the water level, when the upper structure 2 is constructed on SLS 1 to accomplish the construction of SLS 3. In this case, $\gamma_w$ represents the unit weight of water, and V represents the volume of the submerged portion of SLS 3.

As described above, the contact pressure p is found according to the expression of $[(W_1+W_2+W_3-\gamma_w \cdot V]/A$. The ground can be prevented from settlement due to consolidation on condition that the sum of the increment $\Delta\sigma$ of the subsurface stress caused by the contact pressure p and the own weight stress $\sigma_0$ of the subsurface part determined by the self weight of the soil is smaller than the consolidation yield stress $\sigma_y$, i.e., $\sigma_0+\Delta\sigma<\sigma_y$. When V varies with the variation of the water level, the ground can be prevented from settlement on condition that the sum of $\sigma_0$ and the increment $\Delta\sigma_{max}$ of the stress corresponding to the maximum value of the contact pressure p is smaller than the consolidation yield stress $\sigma_y$, i.e., $\sigma_0+\Delta\sigma_{max}<\sigma_y$. The appropriate contact pressure or appropriate consolidation yield stress is attained by means of improving the ground, or slightly excavating the ground together with the ground improvement, while regulating the ballast (i.e., the quantity of water in the ballast tanks 12) so as to satisfy the above expressions.

On the other hand, SLS 1 or SLS 3 mounted with the upper structure 2 can easily resist the horizontal displacement caused by the application of such a force caused by wind, wave or tidal current, with the ground strength of the installation place attained by means of improving the ground or slightly excavating the ground together with the ground improvement. The magnitude of the horizontal force such as wave pressure is determined in proportion to the area of the side face of the structure affected by the horizontal force. However, since the resistance is determined in proportion to the area under installation of the structure, the safety of SLS 1 or 3 is characteristically enhanced, according as the plan of the structure is enlarged.

Incidentally, when a large-scale load such as an earthquake is applied, transmission of such external force to the structure is prevented by appropriate shearing deformation caused in the water-bottom ground, or the slide of the structure relative to the water-bottom ground. Thus, it is possible to stabilize the structure, while keeping the contact with the bottom of the water at all times.

In case where there is a possibility that a vertical load is eccentric within a horizontal plane with the progress of construction of the upper structure 2 onto SLS 1, the quantity of water in each of the ballast tanks 12 is regulated. By so doing, the total weight of the structure is uniformly distributed in plane to avoid the differential settlement, inclination and capsizing of the structure.

The water-bottom ground is improved or excavated in parallel with the manufacture of SLS 1 as shown in FIGS. 8 and 9, or the construction work up to the connnection of SLSs 1, 1 as shown in FIG. 11. SLS 1 or SLS 4 mounted with the upper structure 2 left unfinished is tugged to the candidate water area for installation, where the ground has been already improved or excavated. Then, the ballast tanks 12 are charged with water to submerge the whole of SLS 4 in the water for landing, as shown in FIG. 12. Alternatively, while the upper structure 2 is constructed, the whole of SLS 4 is submerged in the water for landing. When each SLS 1 is independently tugged to the candidate water area for installation, SLSs 1, 1 are connected on the already-improved bottom of the water, as shown in FIG. 11.

SLS 1 is manufactured in a yard in the calm water area as shown in FIGS. 8 and 9, in addition to a dry dock on land. Thus, if the manufacturing yard is set in the vicinity of the candidate water area for installation of SLS 1, it is not necessary to tug SLS 1 over a long distance. Thus, the process of tugging SLS 1 is not required, and besides, SLS 1 can be manufactured in parallel with the improvement of the ground. As a result, the term of works can be shortened.

Figure 14:
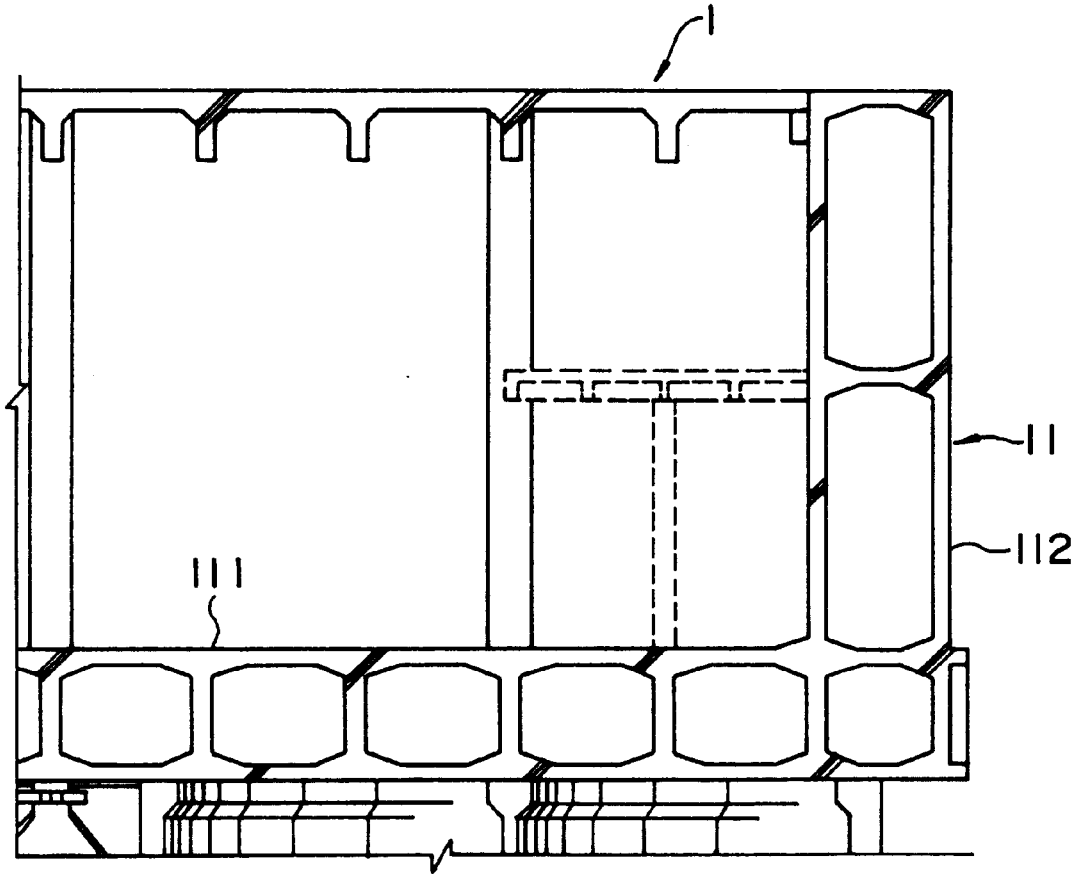
FIG. 14 is a partially enlarged-scale view of FIG. 13.
Figure 15:
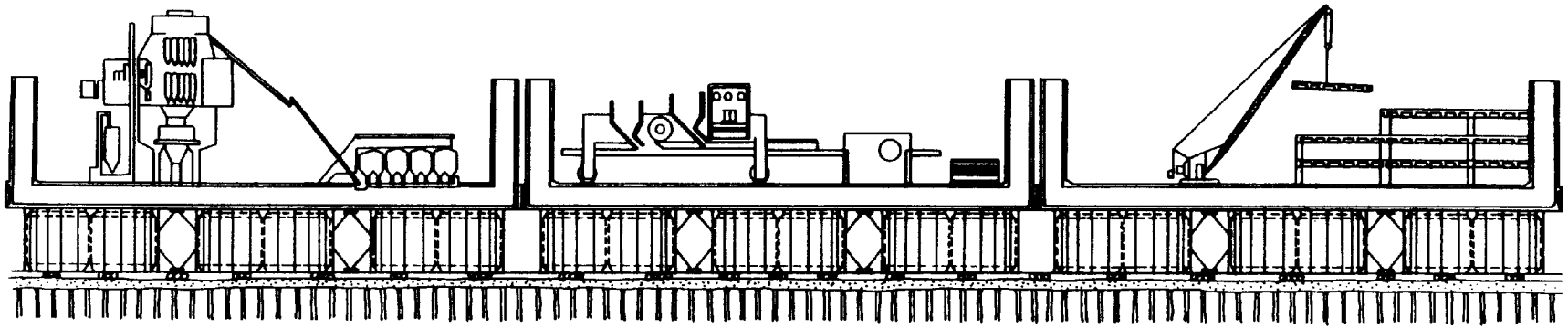
FIG. 15 is a sectional view showing a flow of the execution of works of a structural body, when the upper structure is precast.

FIG. 15 shows the flow of construction of the upper structure 2 onto SLS 1. When the upper structure 2 is constructed by precast concrete as shown in FIG. 14, the construction works including the production of ready mixed concrete, the manufacture of precast concrete members and the assembly thereof can be executed on the structural bodies 11 of each SLS 1 as shown in FIG. 15. Thus, it is not necessary to carry in the members from the land, and as a result, the term of works can be shortened.

Figure 19:
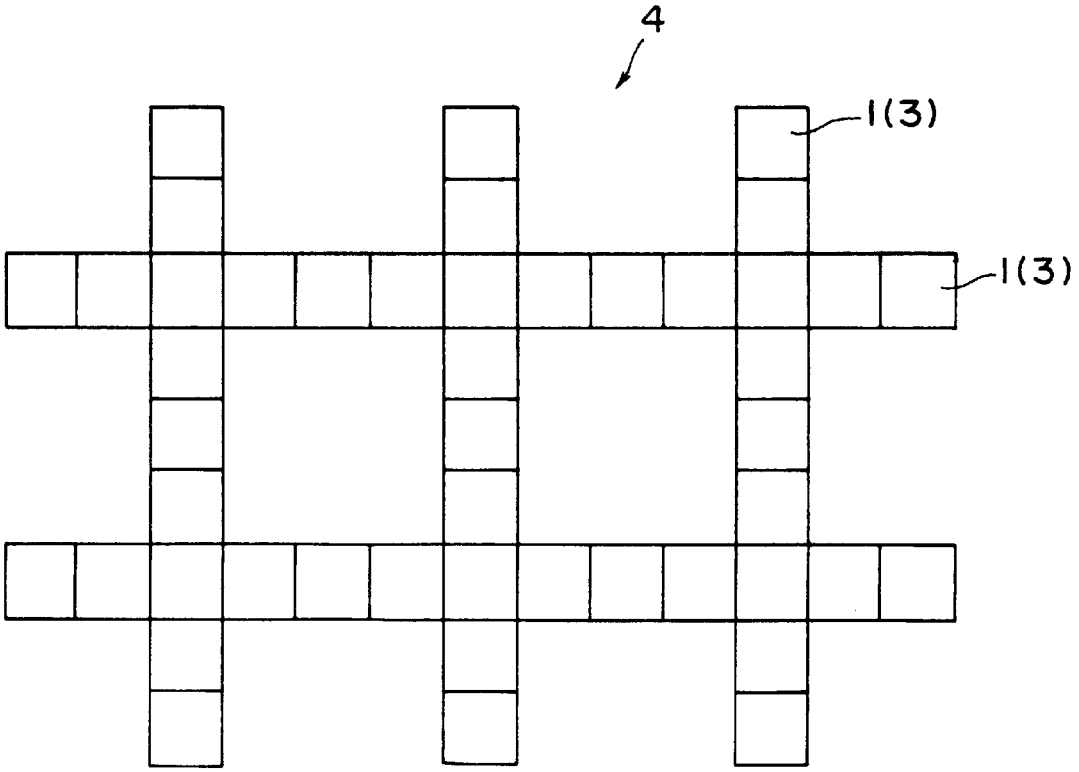
FIG. 19 is a plan view showing SLS 4 when SLS 1 and/or SLS 3 are combined in parallel crosses.

As shown in FIG. 19, SLS 4 is composed of a plurality of SLSs 1 (or 3), which are connected in parallel crosses in plane. The inside water area enclosed by SLSs 1 or 3 is isolated from the outside water area to form the inside calm water area applied to various purposes. For instance, the inside calm water area can be used as recreational facilities such as a bathing resort place, in addition to an ocean ranch and a man-made gathering place for fish.

Figure 20:
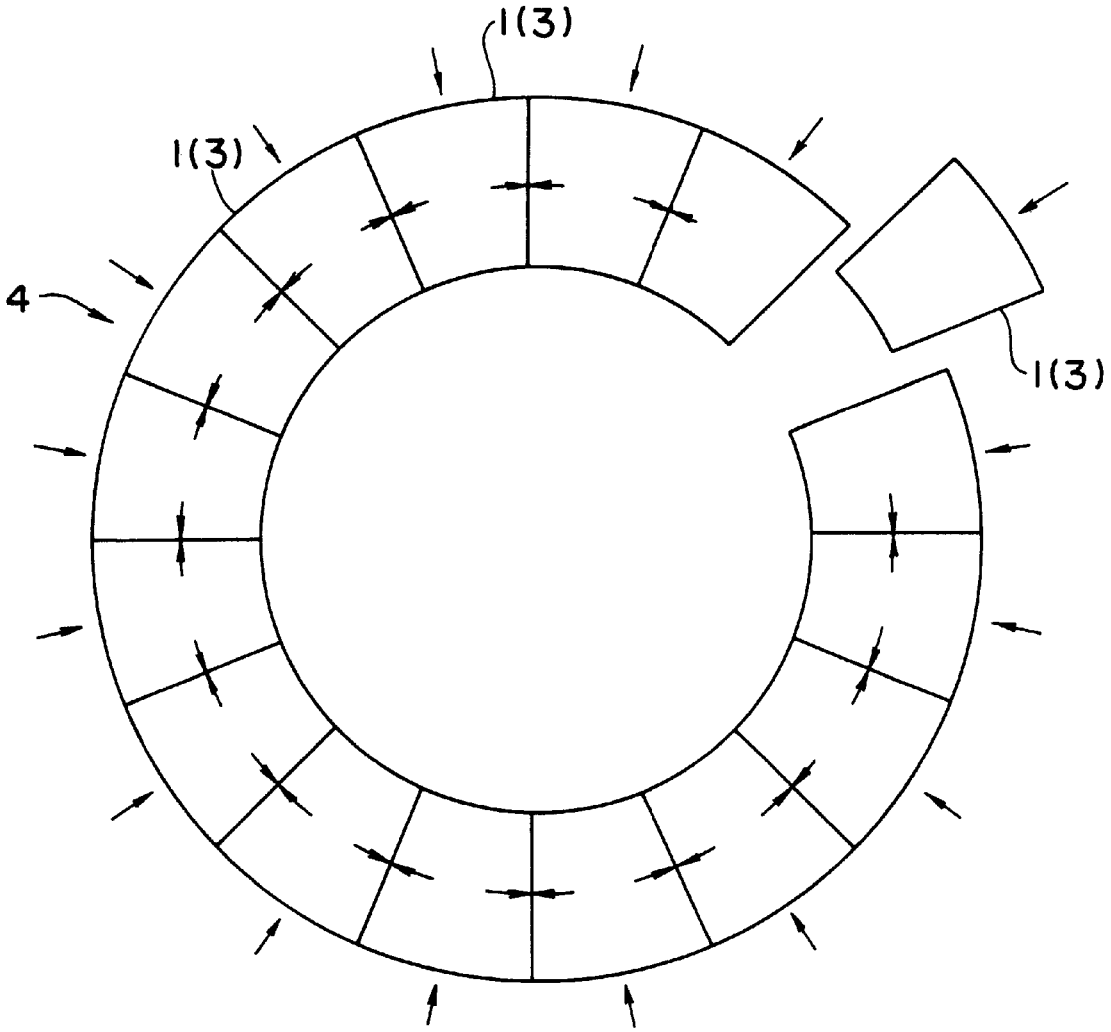
FIG. 20 is a plan view showing SLS 4 when SLS 1 and/or SLS 3 are combined annularly.
Figure 21:
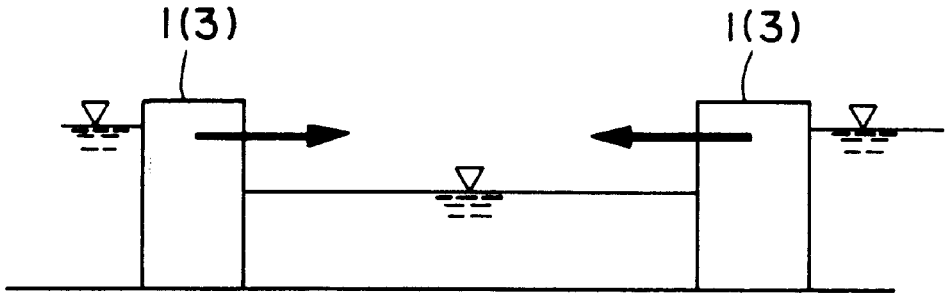
FIG. 21 is a sectional view of FIG. 20.
Figure 22:
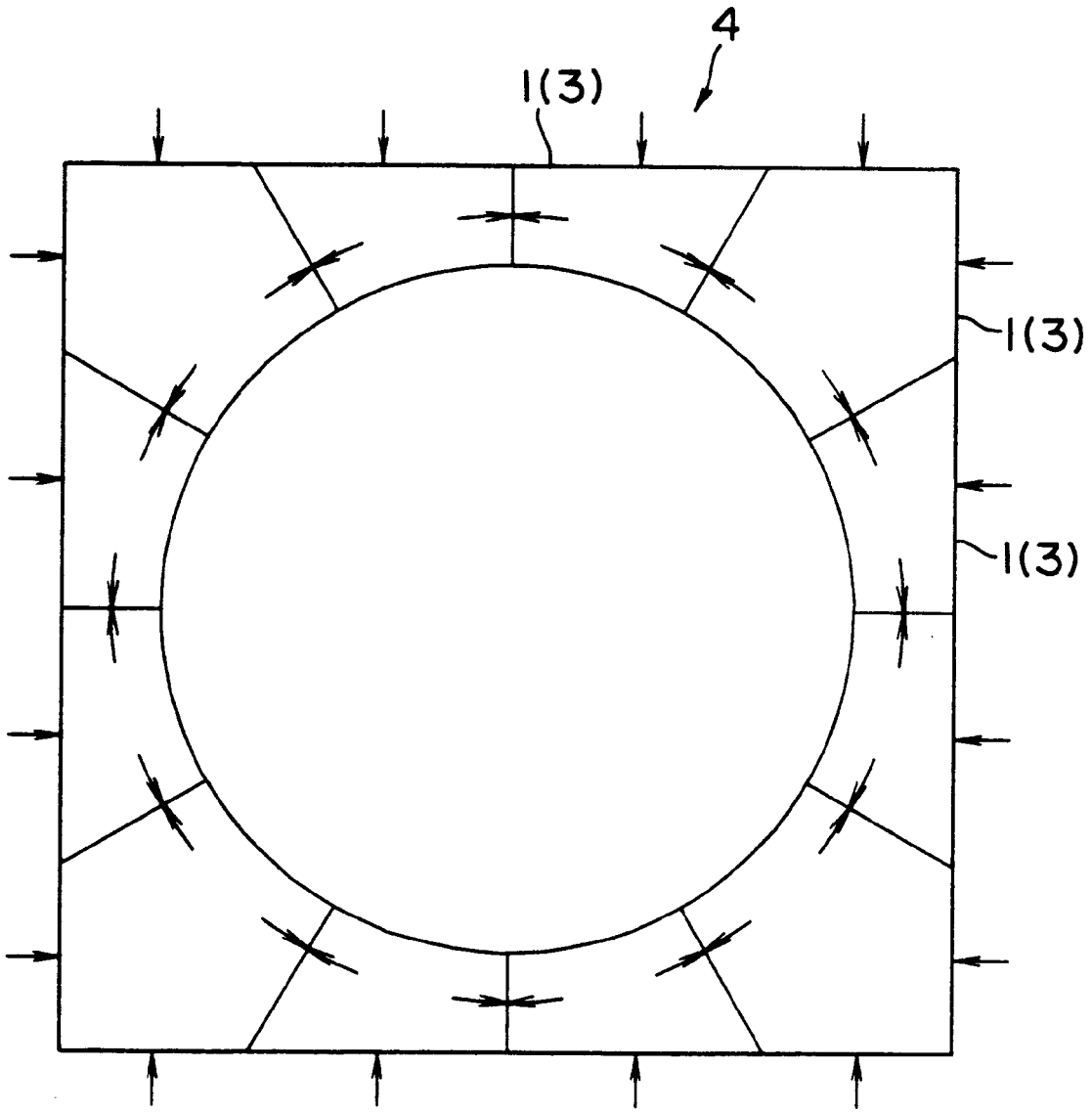
FIG. 22 is a plan view showing another embodiment of SLS 4 combined annularly.

As shown in FIGS. 20 and 22, SLS 4 is composed of a plurality of SLSs 1 (or 3), which are connected annularly in the closed state in plane. When the water level of the inside water area enclosed by SLS 4 constructed in the closed state is set to be lower than that of the water area outside SLS 4 as shown in FIG. 21, force (hoop compression) is allowed to act on the mutually adjacent SLSs 1 (or 3) so as to compressively bring SLS 1 (or 3) into contact with the adjacent SLS 1 (or 3) as shown in FIG. 20, while force (arching) is allowed to act on the mutually adjacent SLSs 1 (or 3) so as to disperse the external force such as water pressure in the circumferential direction, as shown in FIG. 22. According to both the cases of FIGS. 20 and 22, the stability of SLS 4 against external force is enhanced.

In the former case of FIG. 20, the water pressure in the outside water area partitioned by SLS 4 becomes higher than that in the inside water area, and pressure is always applied to SLS 1 (or 3) inwards by an amount corresponding to the difference in pressure between the inside and outside water areas. In this state, the hoop compression acts on the mutually adjacent SLSs 1 (or 3) so as to compressively bring SLS 1 (or 3) into contact with the adjacent SLS 1 (or 3). In the latter case of FIG. 22, although SLS 4 has a square circumference in plane, the inner surfaces of SLSs 1 or 3 are continuously connected together in a circle, and therefore, the water pressure applied from the outside water area toward the inside water area is dispersed in the circumferential direction due to the arching along the inner periphery so as to compressively bring SLS 1 (or 3) into contact with the adjacent SLS 1 (or 3) similarly to hoop compression.

Figure 23:
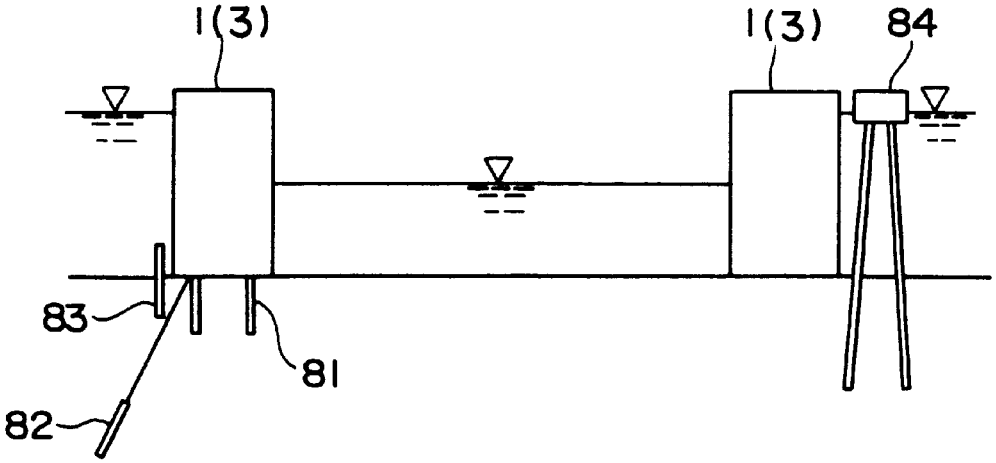
FIG. 23 is a sectional view showing the state of additional members auxiliarily added to SLS 4 shown in FIGS. 19, 20 and 22 or the like so as to ensure the safety.

According to embodiments shown in FIGS. 19 to 22, SLSs 1 (or 3) are connected linearly, and as a result, it may be difficult to maintain the connection between SLSs 1 (or 3), in comparison with a case of connecting SLSs 1 (or 3) in plane. Therefore, as shown in FIG. 23, a shearing key 81 or an anchor 82 is embedded in the bottom of SLS 1 (or 3), or a stopper 83 is installed outside SLS 1 (or 3), or a dolphin 84 is installed in the outside water area to provide for emergencies in case of a great earthquake or the like. Alternatively, other measures can be additionally taken for safety at need. FIG. 23 shows a case where the shearing key 81, the anchor 82, the stopper 83 and the dolphin 84 are applied for safety to the embodiment of FIG. 20.

Figure 25:
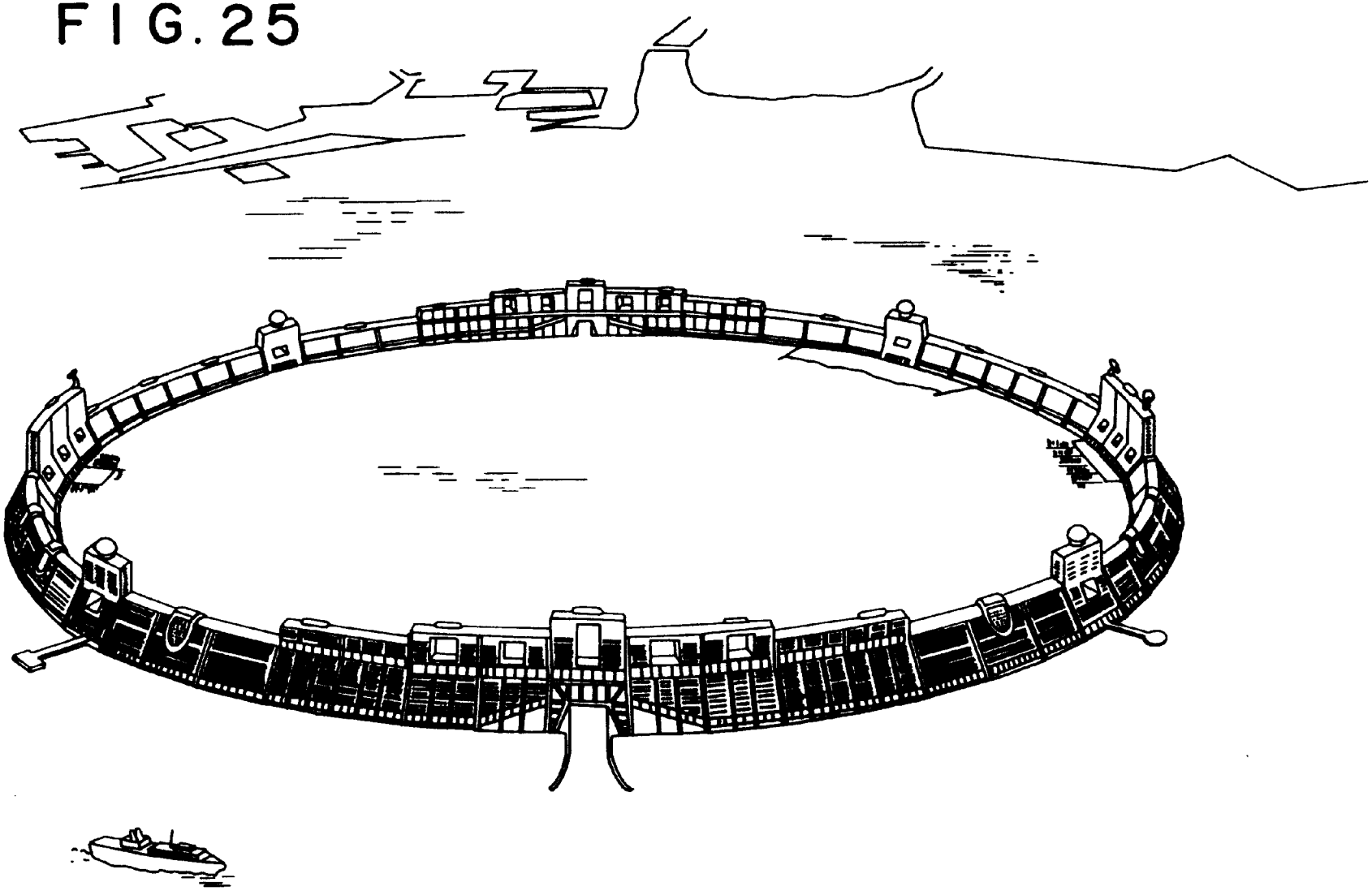
FIG. 25 is a bird's-eye view showing SLS 4 of a type, in which SLSs 1 are provided as a lower structure and connected annularly.
Figure 26:
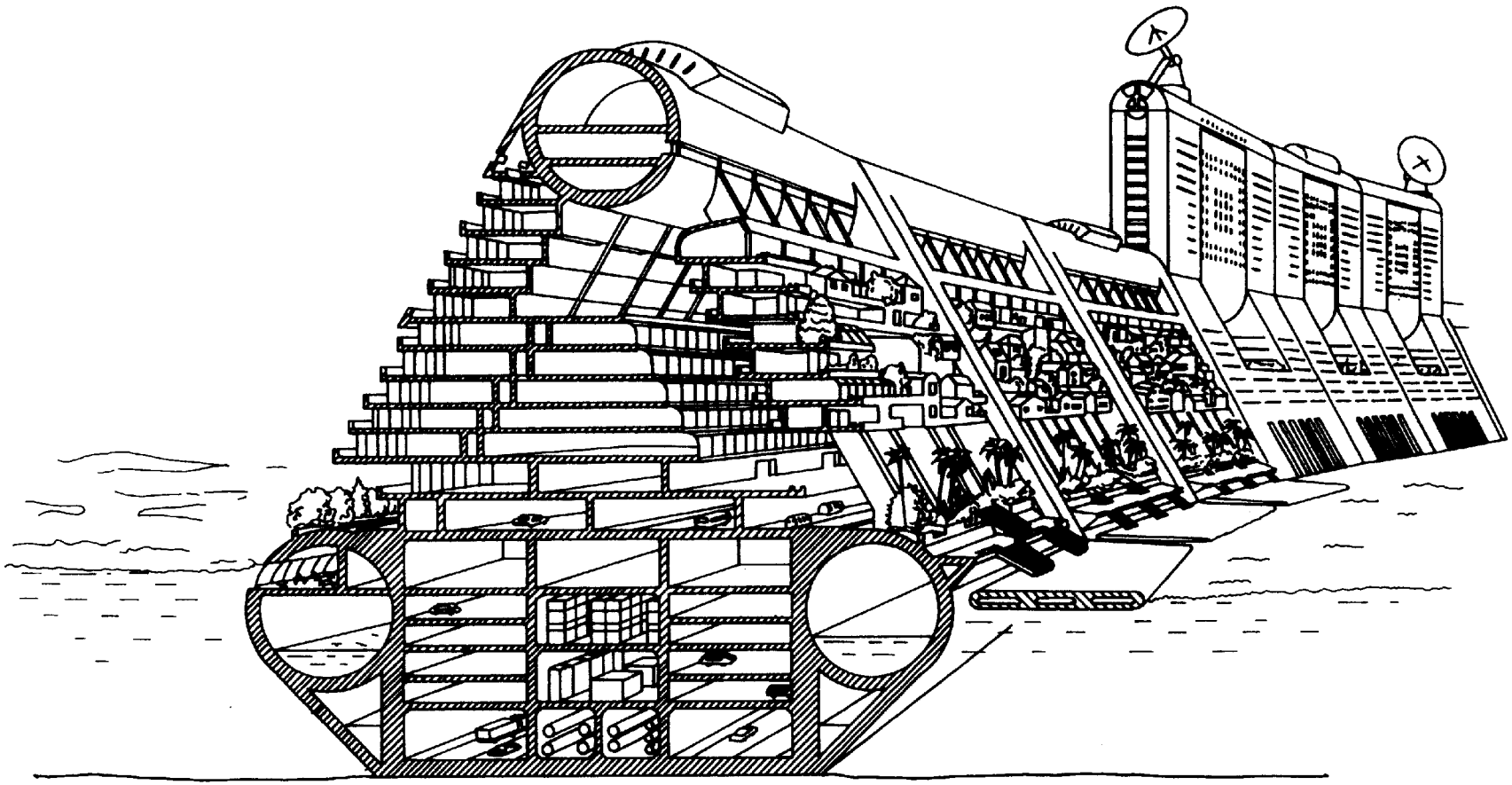
FIG. 26 is a sectional perspective view of FIG. 25.

FIG. 25 shows the state of SLS 4 constructed in a circle using SLS 1 of FIG. 24, and FIG. 26 shows the section of SLS 4 of FIG. 25.

The installation method is to basically install SLS 4 composed of the lower structure constructed by SLS 1 (or 3), for instance, SLS 1 shown in FIG. 1, and the upper structure 2 constructed on the lower structure as shown in FIG. 2. Namely, SLS 1 (or 3) is constructed on the land or water and then tugged to the candidate water area for installation, or constructed in the candidate water area for installation. Subsequently, SLS 1 (or 3) thus constructed lands on the bottom of the water at the appropriate contact pressure by charging the ballast tanks 12 with water.

The installation method is executed as follows. Namely, SLS 1 is constructed as the lower structure, and the water-bottom ground is improved or slightly excavated together with the ground improvement such that the total weight of SLS 3 or 4 including the weight of the lower structure, that of the upper structure 2 and that of water in the ballast tanks 12 is set to be greater than the buoyancy, that SLS 3 or 4 in the landing state does not cause the settlement of ground even if the buoyancy varies, and that SLS 3 or 4 lands on the bottom of the water at the appropriate contact pressure determined enough to withstand the deformation caused by horizontal force. On the other hand, SLS 1 is constructed on the land or water and then tugged to the candidate water area for installation or constructed in the candidate water area for installation. Subsequently, SLS 1 thus constructed once lands on the bottom of the water by charging the ballast tanks 12 with water. Thereafter, the quantity of water in the ballast tanks 12 is regulated such that the range of the total weight of SLS 3 or 4 including the weight of water in the ballast tanks is brought within the set value, while the upper structure 2 is constructed on the lower structure. Consequently, SLS 3 or 4 mounted with the upper structure 2 is installed in the landing state on the bottom of the water, while being accomplished its construction.

The installation method is executed as follows. Namely, the water-bottom ground is improved or slightly excavated together with the ground improvement such that the total weight of SLS 4 including the weight of the lower structure, that of the upper structure 2 and that of water in the ballast tanks is greater than the buoyancy, that SLS 4 in the landing state does not cause the settlement of ground even if the buoyancy varies, and that SLS 4 lands on the bottom of the water at the appropriate contact pressure determined enough to withstand the deformation caused by horizontal force. On the other hand, SLS 1 serving as the lower structure is constructed on the land or water and then tugged to the candidate water area for installation, or constructed in the candidate water area for installation. Subsequently, SLSs 1 thus constructed are connected afloat and then once land on the bottom of the water by charging the ballast tanks 12 with water, while the part or whole of the upper structure 2 is constructed on SLS 1 in the floating state by regulating the quantity of water in the ballast tanks 12. Consequently, SLS 4 mounted with the upper structure 2 is installed in the landing state on the bottom of the water, while the quantity of water in the ballast tanks 12 is regulated such that the range of the total weight of SLS 4 including the weight of water in the ballast tanks is brought within the set value. FIGS. 8 to 12 show the procedure of the installation method according to the present invention as defined in claim 9.

We claim:

1. A soft landing structure constructed on a water bottom ground, comprising:

a ballast tank landed on the water bottom ground, said ballast tank storing water therein an amount of which is regulated, weight of the water in the tank being W1;

a lower structure connected to a top of the ballast tank under the surface of the sea water; and an upper structure mounted on the lower structure, at least a part of said upper structure being positioned above the surface of the sea water, sum of weight of the lower and upper structures being W2;

wherein said water bottom ground under said ballast tank is improved to increase strength of the ground against overall weight of the structure so that a consolidation yield stress of the ground becomes $\sigma_y$; and wherein said water in said ballast tank is regulated to satisfy the following relationships:

$$(W1+W2-\gamma_w V/A>0 \quad (1)$$

$$\Delta\sigma+\sigma_0<\sigma_y \quad (2)$$

where V is volume of a submerged portion of the structure, $\gamma_w V$ represents buoyancy acting on the submerged portion, A represents a surface area under the ballast tank, $\Delta\sigma$ is stress produced by the relationship of (1), and $\sigma_0$ is own weight stress of the water bottom ground.

2. A soft landing structure as defined in claim 1, wherein said water bottom ground under said ballast tank is improved to increase strength of the ground against overall weight of the structure by one or more of improvement methods including a displacement method, a mixing method, a compaction method, a dewatering method and a coagulation method.

3. A soft landing structure as defined in claim 2, wherein said water bottom ground under said ballast tank is improved to increase strength of the ground against overall weight of the structure by one or more of said improvement methods in combination with excavation of the water bottom ground under the ballast tank.

4. A soft landing structure as defined in claim 2, wherein said water bottom ground under said ballast tank is improved to increase strength of the ground against overall weight of the structure through a sand drain method wherein a plurality of sand piles are formed in the ground, a sand mat is provided on the ground, and rubble mound are laid on the sand mat to receive the ballast tank thereon.

5. A soft landing structure as defined in claim 1, wherein a plurality of ballast tanks are arranged at the sea bottom in one or more horizontal directions.

6. A soft landing structure as defined in claim 1, wherein a plurality of structures are connected in one or more horizontal directions to freely enlarge or reduce an entire scale of the soft landing structure.

7. A soft landing structure as defined in claim 1, wherein a plurality of structures are connected in close proximity with one another to form a ring like shape to define an inside calm water area.

8. A soft landing structure constructed on a water bottom ground, comprising:

a ballast tank landed on the water bottom ground, said ballast tank storing water therein an amount of which is regulated, weight of the water in the tank being W1;

a lower structure connected to a top of the ballast tank under the surface of the sea water; and an upper structure mounted on the lower structure, at least a part of said upper structure being positioned above the surface of the sea water, sum of weight of the lower and upper structure being W2;

wherein said water bottom ground under said ballast tank is improved to increase strength of the ground against overall weight of the structure so that a consolidation yield stress of the ground becomes $\sigma_y$; and wherein said water in said ballast tank is regulated to satisfy the following relationships:

$$(W1+W2-\gamma_w V)/A>0 \quad (1)$$

$$\Delta\sigma_{max}+\sigma_0<\sigma_y \quad (2)$$

where V is volume of a submerged portion of the structure, $\gamma_w V$ represents buoyancy acting on the submerged portion, A represents a surface area under the ballast tank, $\Delta\sigma_{max}$ is the largest stress under the relationship of (1) in response to changes in a surface level of said sea water, and $\sigma_0$ is own weight stress of the water bottom ground;

thereby the soft landing structure remaining on the ground of the water bottom and withstanding against horizontal forces produced by sea waves without causing subsidence of the ground.

9. A soft landing structure as defined in claim 8, wherein said water bottom ground under said ballast tank is improved to increase strength of the ground against overall weight of the structure by one or more of improvement methods including a displacement method, a mixing method, a compaction method, a dewatering method and a coagulation method.

10. A soft landing structure as defined in claim 9, wherein said water bottom ground under said ballast tank is improved to increase strength of the ground against overall weight of the structure by one or more of said improvement methods in combination with excavation of the water bottom ground under the ballast tank.

11. A soft landing structure as defined in claim 8, wherein said water-bottom ground under said ballast tank is improved to increase strength of the ground against overall weight of the structure through a sand drain method wherein a plurality of sand piles are formed in the ground, a sand mat is provided on the ground, and rubble mound are laid on the sand mat to receive the ballast tank thereon.

12. A soft landing structure as defined in claim 8, wherein a plurality of ballast tanks are arranged at the sea bottom in one or more horizontal directions.

13. A soft landing structure as defined in claim 8, wherein a plurality of structures are connected in one or more horizontal directions to freely enlarge or reduce an entire scale of the soft landing structure.

14. A soft landing structure as defined in claim 8, wherein a plurality of structures are connected in close proximity with one another to form a ring like shape to define an inside calm water area.

15. A method of installing a soft landing structure, comprising the following steps of:

constructing the soft landing structure on a land or water, said soft landing structure including a ballast tank for storing a desired amount of water therein, a lower structure connected to a top of the ballast tank, and an upper structure mounted on the lower structure at least a part of said upper structure being positioned above a surface of the sea water;

tugging the soft landing structure that has been constructed to a candidate water area for installation;

improving the water bottom ground under said ballast tank in such a way to increase strength of the ground against overall weight of the soft landing structure; and installing the soft landing structure on the water bottom ground to complete the soft landing structure under the condition that the amount of water in the ballast tank is regulated so that the soft landing structure remains on the water bottom ground without floating up and without causing subsidence of the ground even if a sea water level varies, and stays on the water bottom ground with appropriate contact pressure enough to withstand against horizontal forces caused by sea waves.

16. A method of installing a soft landing structure as defined in claim 15, wherein said water bottom ground under said ballast tank is improved to increase strength of the ground against overall weight of the structure by one or more of improvement methods including a displacement method, a mixing method, a compaction method, a dewatering method and a coagulation method.

17. A soft landing structure as defined in claim 16, wherein said water bottom ground under said ballast tank is improved to increase strength of the ground against overall weight of the structure by one or more of said improvement methods in combination with excavation of the water bottom ground under the ballast tank.

18. A soft landing structure as defined in claim 15, wherein said water-bottom ground under said ballast tank is improved to increase strength of the ground against overall weight of the structure through a sand drain method wherein a plurality of sand piles are formed in the ground, a sand mat is provided on the ground, and rubble mound are laid on the sand mat to receive the ballast tank thereon.

19. A method of installing a soft landing structure, comprising the following steps of:

constructing the soft landing structure on a land or water, said soft landing structure including a ballast tank for storing a desired amount of water therein, a lower structure connected to a top of the ballast tank, and an upper structure mounted on the lower structure at least a part of said upper structure being positioned above a surface of the sea water;

tugging the soft landing structure that has been constructed to a candidate water area for installation;

improving the water bottom ground under said ballast tank in such a way to increase strength of the ground against overall weight of the soft landing structure; and installing the soft landing structure on the water bottom ground to complete the soft landing structure;

controlling the amount of water in the ballast tank to satisfy the following relationships:

$$(W1+W2-\gamma_w V)/A>0 \quad (1)$$

$$\Delta\sigma+\sigma_0<\sigma_y \quad (2)$$

where W1 is a sum of weight of the upper and lower structures, W2 is weight of the water in the ballast tank, V is volume of a submerged portion of the soft landing structure, $\gamma_w V$ represents buoyancy acting on the submerged portion, A represents a surface area under the ballast tank, $\Delta\sigma$ is stress produced by the relationship of (1), $\sigma_0$ is own weight stress of the water bottom ground, and $\sigma_y$ is a consolidation yield stress of the water bottom ground after said improvement.

20. A method of installing a soft landing structure as defined in claim 19, wherein said water bottom ground under said ballast tank is improved to increase strength of the ground against overall weight of the structure by one or more of improvement methods including a displacement method, a mixing method, a compaction method, a dewatering method and a coagulation method.

21. A soft landing structure as defined in claim 20, wherein said water bottom ground under said ballast tank is improved to increase strength of the ground against overall weight of the structure by one or more of said improvement methods in combination with excavation of the water bottom ground under the ballast tank.

22. A method of installing a soft landing structure, comprising the following steps of:

constructing the soft landing structure on a land or water, said soft landing structure including a ballast tank for storing a desired amount of water therein, a lower structure connected to a top of the ballast tank, and an upper structure mounted on the lower structure at least a part of said upper structure being positioned above a surface of the sea water;

tugging the soft landing structure that has been constructed to a candidate water area for installation;

improving the water bottom ground under said ballast tank in such a way to increase strength of the ground against overall weight of the soft landing structure; and installing the soft landing structure on the water bottom ground to complete the soft landing structure;

controlling the amount of water in the ballast tank to satisfy the following relationships:

$$(W1+W2-\gamma_w V)/A>0 \quad (1)$$

$$\Delta\sigma_{max}+\sigma_0<\sigma_y \quad (2)$$

where W1 is a sum of weight of the upper and lower structures, W2 is weight of the water in the ballast tank, V is volume of a submerged portion of the soft landing structure, $\gamma_w V$ represents buoyancy acting on the submerged portion of the soft landing structure, A represents a surface area under the ballast tank, $\Delta\sigma_{max}$ is the largest stress under the relationship of (1) in response to changes in a surface level of said sea water, $\sigma_0$ is own weight stress of the water bottom ground, and $\sigma_y$ is a consolidation yield stress of the ground after said improvement;

thereby the soft landing structure remaining on the ground of the water bottom and withstanding against horizontal forces produced by sea waves without causing subsidence of the ground.

* * * * *